US005775778A

United States Patent [19]

Riley et al.

[11] Patent Number: 5,775,778

[45] Date of Patent: Jul. 7, 1998

[54] SHAPE ADAPTABLE AND RENEWABLE FURNITURE SYSTEM

[75] Inventors: Paula Riley, New York; Kenneth V. Stevens, Brooklyn, both of N.Y.

[73] Assignee: Prescient Partners, LP, New York, N.Y.

[21] Appl. No.: 608,694

[22] Filed: Feb. 29, 1996

[51] Int. Cl.[6] ..... A47C 4/02

[52] U.S. Cl. ..... 297/440.1; 297/218.5; 297/226; 297/440.2; 297/452.12; 297/452.38

[58] Field of Search ..... 297/28.5, 219.1, 297/225, 226, 228, 440.1, 440.11, 440.2, 440.14, 452.11, 452.12, 452.38

[56] References Cited

U.S. PATENT DOCUMENTS

| | | | |
|---|---|---|---|
| 497,696 | 5/1893 | Wenzel . | |
| 2,151,985 | 3/1939 | Munroe . | |
| 2,164,715 | 7/1939 | Krainbill . | |
| 2,597,860 | 5/1952 | Gerber et al. | 297/440.23 X |
| 2,620,024 | 12/1952 | Rietman . | |
| 2,642,928 | 6/1953 | Bateman . | |
| 3,066,982 | 12/1962 | Brower . | |
| 3,104,913 | 9/1963 | Faulkner et al. | 297/411.28 X |
| 3,116,953 | 1/1964 | Sugarman | 297/228 X |
| 3,221,348 | 12/1965 | Siegel | 297/440.21 X |
| 3,563,599 | 2/1971 | Heumann . | |
| 3,608,959 | 9/1971 | Sarvas . | |
| 3,632,150 | 1/1972 | Milakovich . | |
| 3,658,382 | 4/1972 | Anderson . | |
| 3,669,494 | 6/1972 | Lohmeyer . | |
| 3,929,375 | 12/1975 | Gans . | |
| 3,955,850 | 5/1976 | Toso . | |
| 3,973,800 | 8/1976 | Kogan . | |
| 4,077,666 | 3/1978 | Heumann . | |
| 4,140,065 | 2/1979 | Chacon . | |
| 4,285,544 | 8/1981 | Zapf | 297/440.21 |
| 4,455,008 | 6/1984 | MacKew | 297/188.18 X |
| 4,523,787 | 6/1985 | Robinson . | |
| 4,621,381 | 11/1986 | Schramek . | |
| 4,672,698 | 6/1987 | Sands . | |
| 5,080,438 | 1/1992 | Moyer | 297/440.23 |
| 5,112,110 | 5/1992 | Perkins | 297/440.21 |
| 5,263,764 | 11/1993 | Laughlin et al. . | |
| 5,265,939 | 11/1993 | Self et al. . | |

*Primary Examiner*—Peter R. Brown
*Attorney, Agent, or Firm*—Notaro & Michalos P.C.

[57] ABSTRACT

Shape-adaptable furniture has a core element to which interchangeable portions are easily added or removed to alter the appearance and function of the furniture to suit a user's tastes. Different seat back coverings, having varied padding and styling are added to the L-shaped core element using fasteners to hold the seat back in place. Two embodiments for armrests are provided. One embodiment uses fastening devices similar to those used for the seat back covering to hold arm rest covers with varied padding and styling which match the back covering style. In a second embodiment, the arm rests are easily interchangeable units separable from the core element. Accessories for use with the furniture are also provided.

51 Claims, 21 Drawing Sheets

SHAPE ADAPTABLE AND RENEWABLE FURNITURE SYSTEM

FIELD AND BACKGROUND OF THE INVENTION

The present invention relates to furniture which can be easily changed to a different style, appearance and enhanced function, simply by adding and removing modules and accessories to and from a base structure adapted to accept the modules and accessories.

For many years, furniture makers have sought to reduce costs of manufacturing, shipping, warehousing and inventory management by fabricating furniture components that can be assembled into a single final functioning product by the consumer. This "ready-to-assemble" furniture, formerly known as KD, or "knockdown" furniture, has become a mainstay of the case goods or non-seating part of the furniture industry. Many modular and knockdown upholstered furniture systems have also been patented, and some are available in the marketplace.

Some of the efficiency brought about by this type of furniture has been passed on to consumers in the form of lower prices, faster shipping because smaller containers can be used to transport the sections of the furniture, and ease of repair, because a broken section may be removed and replaced by a new component. Much of the advantage of this type of component furniture, however, has mainly gone to the manufacturers and retailers. The consumer has not gained more choices of styles or designs or functionality.

Also, current forms of knockdown furniture are less resistant to normal wear and tear, they are assembled in sections and are therefore not as sturdy as single unit furniture. Further, when a fabric cover wears through or frays with known furniture, the entire unit or section must be recovered or replaced.

One known solution to this problem is found in U.S. Pat. No. 3,248,147, which discloses a removable slipcover for furniture arms that simulates a tailored appearance similar to conventional upholstered furniture. However, the slipcovers disclosed are expensive to produce and provide little flexibility in styling since they are suitable only for furniture with substantially perpendicular arms.

Currently, a new couch is manufactured from several component parts, all of which are manufactured to have the same single style so they will match each other when together. The style of the couch cannot be changed to reflect a consumer's new tastes without discarding the entire couch and rebuilding a new one. This is because the individual components, such as the back, arms and seat, may not be altered or changed from their original style without completely remaking them in the new style.

Examples of known knockdown furniture can be found in several patents, including U.S. Pat. No. 2,597,860, which shows a piece of furniture assembled from modular sections, but which is not changeable once assembled. Also see U.S. Pat. Nos. 2,151,985; 2,164,715; 2,620,024; 2,642,928; 3,066,982; 3,563,599; 3,608,959; 3,658,382; 3,632,150 and 3,669,494.

U.S. Pat. No. 3,973,800 teaches a modular furniture unit which is comprised of several individual pieces which are assembled to form a single piece of furniture. This construction also has the disadvantages of being difficult to change, since one or more modular pieces must be replaced, and being less sturdy, since the back and seat are only connected by simple hooking devices. Another patent teaching knockdown furniture is U.S. Pat. No. 3,929,375 for a sofa which is held together by a system of grooves and hook-and-loop strips. Also see U.S. Pat. Nos. 4,077,666; 4,140,065; 4,523,787; 4,621,381; 4,632,459; 4,672,698; 5,080,438; 5,112,110 and 5,265,939.

Furniture with interchangeable parts is shown in U.S. Pat. No. 5,263,764, which discloses an upholstered furniture piece having a removable section that can be configured to be a seat or a sleeper, and further which has removable upholstery for changing the appearance of the furniture. The furniture of this patent, while more adaptable than other known furniture, still has disadvantages, most notably, that the back is not securely fixed. Additionally, the fabric covers are attached to the furniture frame only by hook-and-loop fastener strips.

None of the known furniture types is capable of having its styling and shape quickly and easily altered by using interchangeable parts and shape altering components for the back and arms of a sofa or chair frame. Nor are any known types designed for the easy attachment of the aforementioned components and of added functional components to be installed by the end user (the purchaser or consumer).

SUMMARY OF THE INVENTION

It is a primary object of the present invention to provide a new and useful type of furniture which provides more choices to consumers and allows a consumer to easily change the styling and add to the function of the furniture without discarding the entire piece.

Another object of the invention is to provide a product line which presents the consumer with a high quality, durable, basic product which can be altered, accessorized and renewed with ease. This will give consumers the ability to change the shape, profile, period style, padding, texture, and fabric—both in color and pattern, of the seating, with the same freedom that they now change a bed and bedspread. Unlike current upholstered furniture programs which emphasize the sale of the sofa as a one time purchase, this inventive system begins with a significant initial sale and provides for a succession of follow-up sales as the consumer renews the appearance of the seating, redecorates over time, and adds functional components.

For this invention, the furniture system or seating is meant to include sofas, chairs, loveseats and other upholstered seats with a seating area, a back and at least one arm rest together with a variety of functional accessories.

The elemental core of the upholstered seating system of the invention is a back and a seating base with feet. This basic "L" shape, fabricated as a strong integral unit, is the structural core of this invention of shape adaptable and renewable furniture. The basic "L" shaped core element is made to have a desired length, width and height and a fixed, upholstered thickness of the seat and back portions. The structural frame and cross members of wood, metal and/or plastic are built with supportive seat and back springs, resilient membranes or stretch bands attached and upholstered with a variety of padding and covered, e.g. in a muslin fabric. Four supporting feet can also be designed with auxiliary fastening capabilities.

The core element can be altered in its fundamental shape, softness and profile with the addition of broad contour mats of padding that are first, inserted and attached at an intersection between the seat and back, second, stretched and attached at a groove line running longitudinal at the top edge of the back and, finally, attached beneath the frame all along the back base line with either a reinforcement stripped series of button and keyholes, hook-and-loop strips, tab and groove flexible fasteners, or snaps.

At least part of the arm or arms for the invention are fabricated separately and are attached by the consumer. The full arm modules have bottom locator feet which are mated with fasteners, e.g. tabs and socket, on the feet of the basic "L" element. Once mated, the arms are rotated upwardly into place against the right and left ends of the core element. Anchors such as spring loaded studs, e.g. quarter turn or threaded studs, on each end of the core element engage three opposing sockets in the arms and firmly affix them to the core. The arms can be fabricated in different ways. For example, a universal, interchangeable full arm is padded and upholstered, e.g. in muslin, and can be altered in shape and style with the addition of contour mats or shaping modules similar to those used on the back, or an assortment of distinctly styled and padded arms are fabricated and attached to the end of the core elements, as completed components. The upper quadrant of the arm front and back ends have a unique fastener/receptacle for attaching both decorative and functional elements and for connecting a final dedicated slipcovering. With either approach, the arms can be fat or thin, roll topped, tear-drop shaped deco, or Lawson styled. A lower part of the arm can also be fixed to the core, and only an upper arm module added to alter the shape of the arm.

With no-tool, quick-connect, attachment of the arms, and placement of seat cushions, the invention is ready for the appropriate slipcover. Each ensemble of arm and contoured back cover module or padding has a customized slipcover sewn for it. The covers are held in place at the corners and baselines by a combination of zippers and hook-and-loop fasteners to give a custom appearance. Around the seating area, deep expanding channels or pockets are provided for holding a slipcover that is tucked deeply in at the sides and behind the seat cushions. Custom fitting lengths of a multi-winged, elastomeric extrusion baton are inserted into these horizontal channels or pockets. The batons are pressed down in between the springs and frame beneath the cushion until they engage in their slipcover pocket and expand to fit into the channels in the core element frame and arm structures, at the back and sides. The multi-winged batons expand and anchor the slipcover firmly in place. According to decorative choice the slipcover may be skirted or not, pre-attached or consumer attached.

Another styling option enables the consumer to select the shape and material of the feet. Bun feet, grooved or plain straight feet, in wood, metal or fabric covering are available. Similarly the front of each arm can have a pleated, buttoned, tufted or variously finished detail which doubles as a slipcover attachment point in an area that is prone to cover shifting and displacement.

Accordingly, the invention is a piece of furniture or furniture system having a core element which is roughly L-shaped to form the seat and back and having means for connecting an interchangeable shaping module or covering for the back and side arms, which are connectable to the core element. The side arm or arms may also have means for connecting an interchangeable shape altering module to each arm, or they may be entirely removable and replaceable. The feet are attached to the base of the core element to support it off the floor. The feet may be decorative or plain and are also interchangeable.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
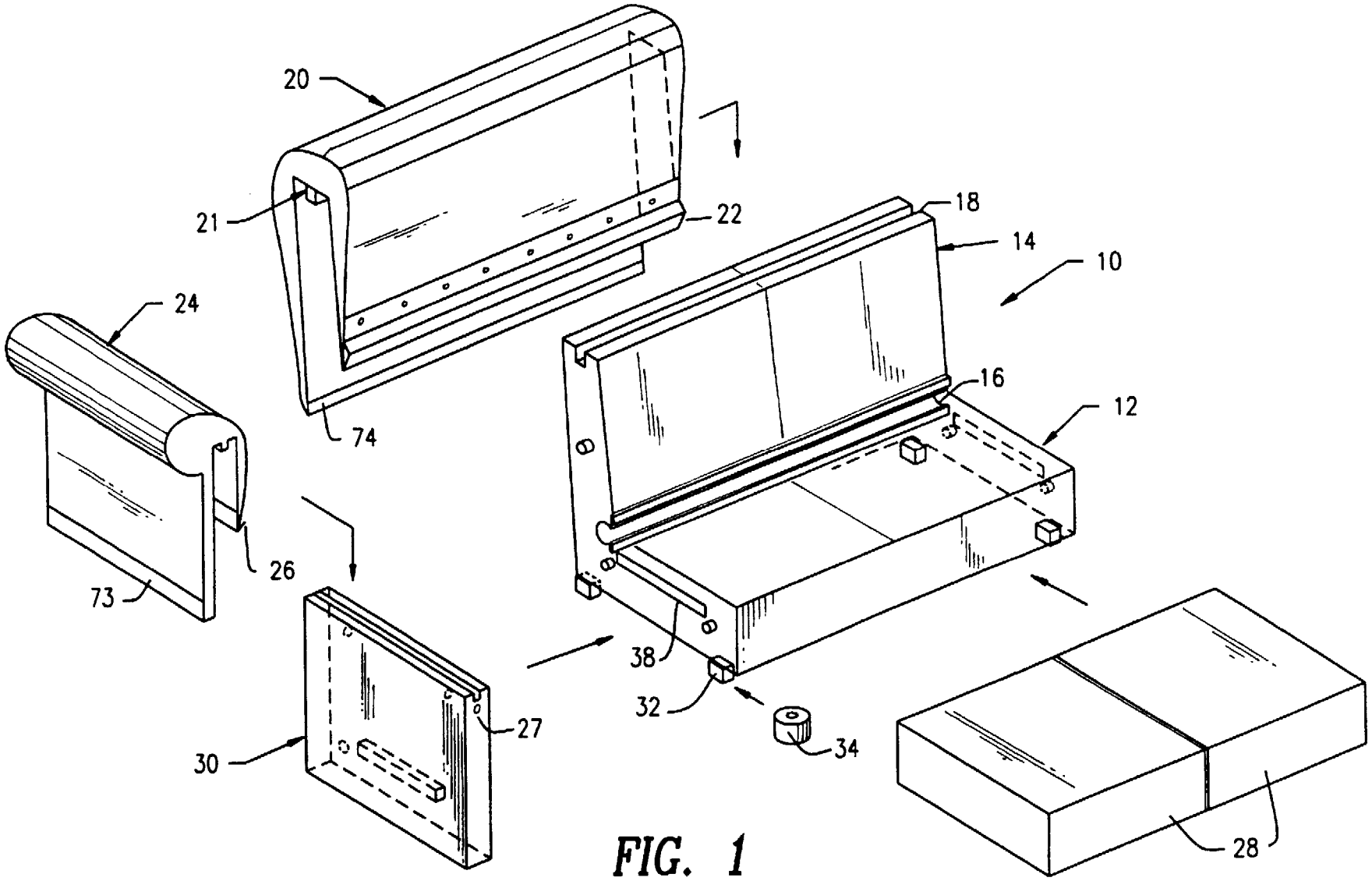
FIG. 1 is an exploded view of one embodiment of the furniture system of the present invention.
Figure 2:
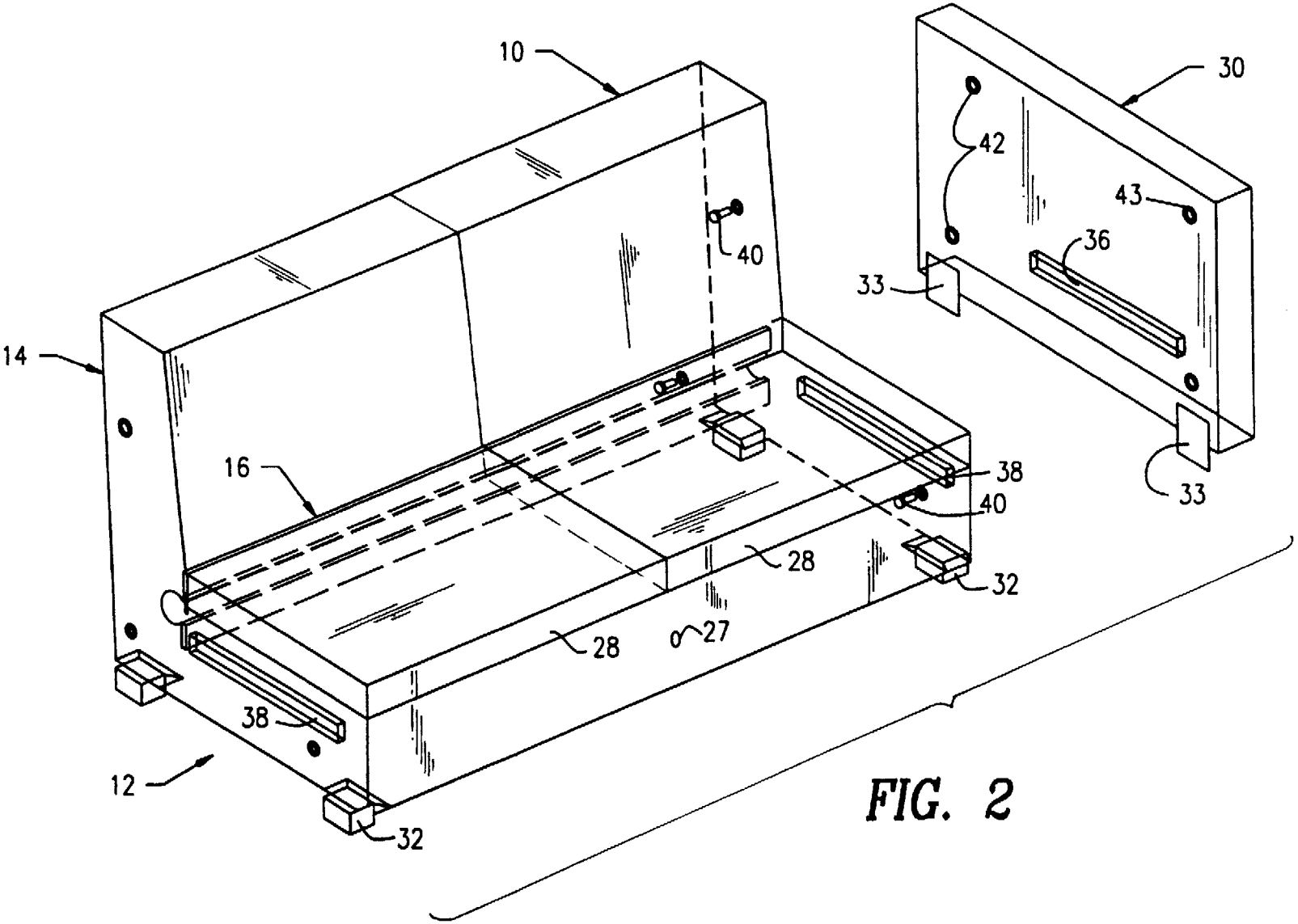
FIG. 2 is an exploded view of a core element and full arm module of the first embodiment.
Figure 3:
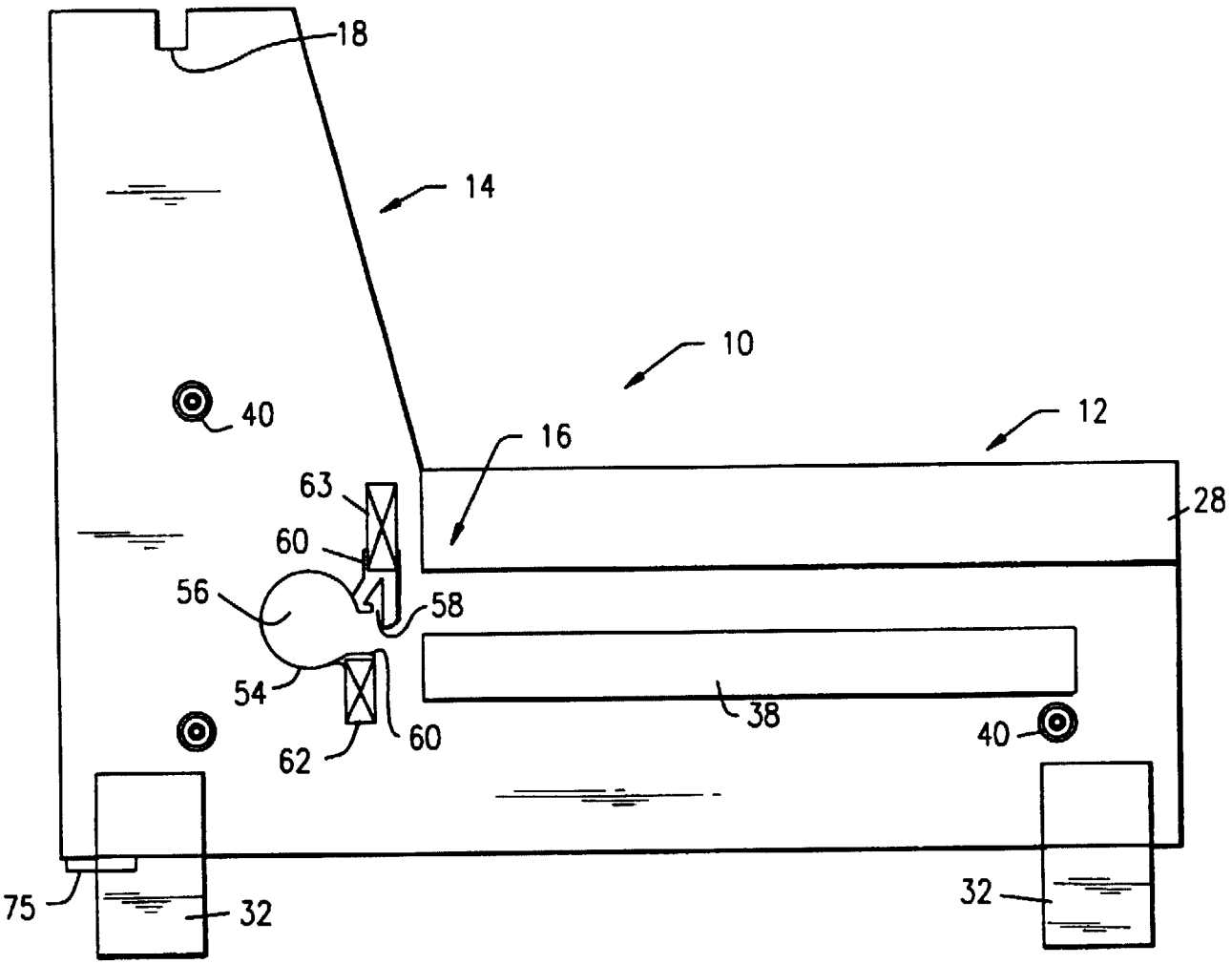
FIG. 3 is an end view of the core element.

Referring to the drawings in particular, the invention embodied in FIGS. 1, 2 and 3, comprises a generally L-shaped core element generally designated 10, having a horizontally extending seat portion 12 and a vertically extending back portion 14 connected to and forming a non-detachable single structural unit with the seat portion 12. The back and seat portions are connected to each other at an elongated intersection shown at 16 near the base of the front surface of the back portion, and share the same strong internal frame structure.

The terms "vertically" and "horizontally" are meant to include typical angles from true vertical and true horizontal directions, which are typical for the seating and back portions of sofas, loveseats, chairs and other seating.

As best shown in FIG. 1, the furniture system of the present invention also includes a back shaping or cover module generally designated 20 which is detachably connected to the core element and which extends over the back portion 14. For this purpose, the back shaping module 20 includes a front lower edge 22 which is designed so that it can be detachably fixed to the elongated intersection 16 for holding a front portion of the back shaping module, over the front of the back portion 15.

The furniture system of the present invention also includes at least one full arm module shown for example at 30 in FIG. 2, detachably connected to one end of the core element. In the embodiment of FIG. 2, module 30 is a full arm module which extends from the lower surface or end of the seat portion of the core element, to an arm rest level which is conventional for the upper surface of the arm, above the seating area of the seat portion 12. The invention also includes the possibility of utilizing an upper arm module which only includes the upper portion of the arm, and which will be explained in connection with FIG. 8.

Referring once more to FIG. 1, the core element and arm module, as well as the back shaper, are all upholstered structures including an outer muslin covering and underlying cushioning. With regard to the core element, springs or other supports are also provided and internal frames are provided to make the L-shaped core element strong and rigid for use. An important feature of the invention is the merging of the seat and back portions into one structural unit. This is an important distinction over earlier module designs which tended to separate the seat from the back. By merging the seat and back portion they can be constructed to be sturdy and strong for use even if the furniture is abused, for example, by individuals sitting on the back portion.

The arm module 30 is also a framed, upholstered and cloth covered structure.

As shown in FIG. 1, an arm shaping module 24 may also be used in conjunction with the plain rectangular arm module to give it a new profile. As with the back shaping module 20, the arm shaping module 24 includes a lower front or inner edge 26 which can be detachably anchored to holding means built into the arm module as will be described in connection with FIG. 10.

One or more upholstered seat cushions 28 may also be used in conjunction with the invention, also muslin covered as on the back shaping module 20 and the arm shaping module 24.

Core element 10 also includes a plurality, advantageously four modular feet 32 which are shaped to be exposed or to be covered by modular feet covers 34. As with back and arm shapers 20 and 24, foot covers 34 can be used to change the look and shape of the furniture to drastically alter its style. For example, a back shaper having a "camel back" shape may be used or just a gracefully arched shape as shown in FIG. 1 or a straight back. Further, square designs may be incorporated into the shaping modules or rounded designs, again for the purpose of substantially changing the desired resultant shape, appearance, silhouette, profile or style of the furniture.

To help center the back shaper module 20 onto the back 14 of the core element 10, a groove 18 may be formed across the center of the upper surface of back 14, for receiving an elongated rib 21 extending along the inner surface at the top of the cover module. This groove is optional however, and while being shown in the embodiment of FIGS. 1 and 3, is not shown in the embodiment of FIG. 2.

Turning to FIG. 2, arm module 30 incudes a groove 36 in its inside surface shaped to receive a projecting rib 38 extending from the side surface at the end of core 10. This helps firmly position the arm module to the end of the core element. To fix the arm module to the core element, a plurality, for example, three anchor pins or bolts 40, extending through openings in a side wall of the core element, engage an equal number of recesses or nuts 42, in the side wall of the arm module. It is noted that arm module 30 includes an extra anchor recess 43 which can be used for attaching accessories to the modular furniture. It is also noted that although all outer surfaces of the core element and arm modules are covered by cloth, both modules are essentially framed hollow structures. At locations near the anchor structures 40 and 42, the cloth is held in place only by detachable structures such as buttons, zippers or hook-and-loop tapes, so that the fabric can be moved aside to allow hands and tools to be inserted for attaching the anchors. It is also noted that the "cloth" is meant to include all flexible sheet material that is suitable for furniture, such as fabric, vinyl and leather.

Figure 5:
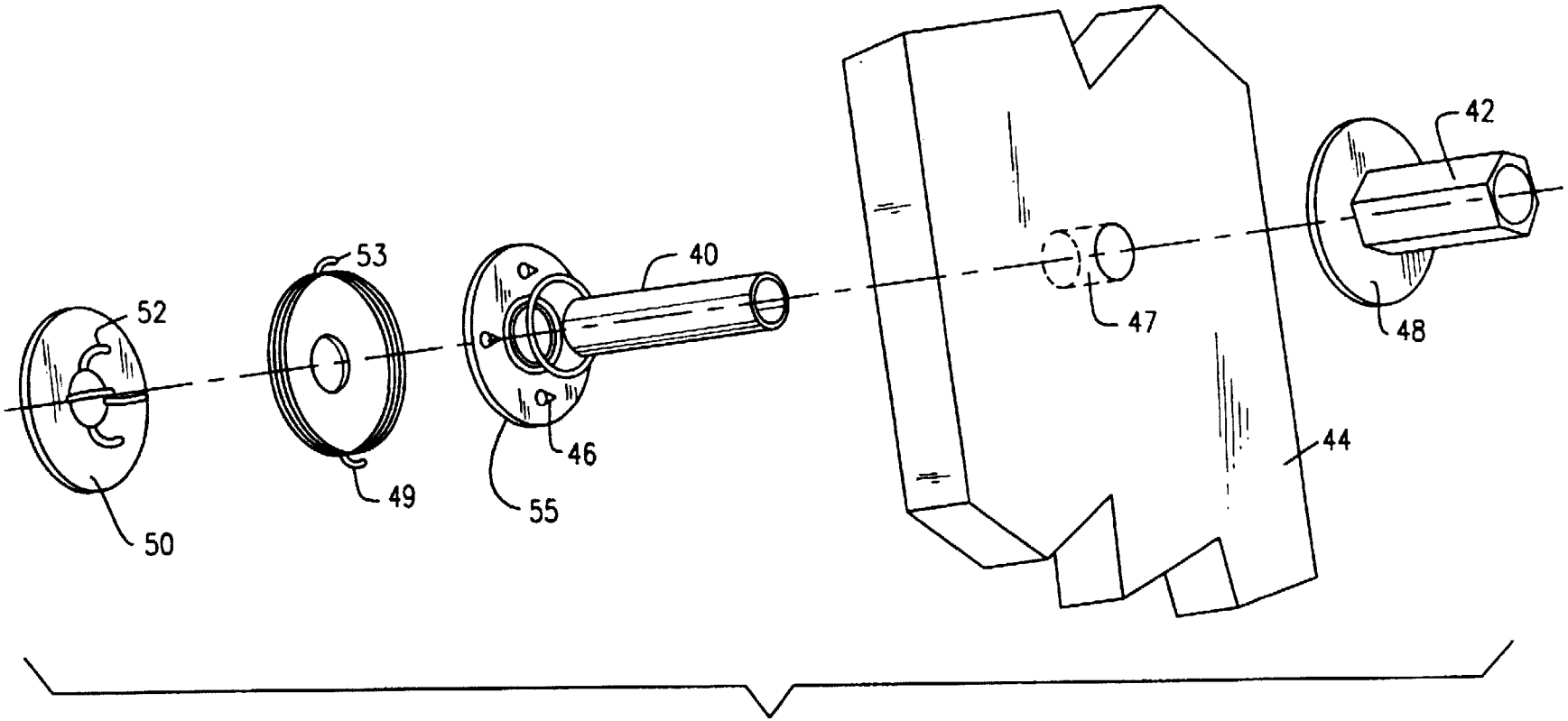
FIG. 5 is an exploded view of an anchor assembly for attaching the arms to the core element and for anchoring accessories to the arms, of the present invention.

FIG. 5 illustrates details of the anchor assembly which includes the anchor bolt 40 that may have a head and threaded shaft for being threaded into the threaded opening of an anchor nut 42 having a shank with an outer hexagonal shape so that it can be engaged by a wrench. The bolt and nut can be connected to holes in the side walls of the core element and arm module, one of which being shown at 44. Wall 44 may also represent the front or rear wall of the arm or core and the FIG. 5 assembly used to hold accessories to fasteners or recesses 27 or 97.

Pointed stops 46 project from the undersurface of the head 55 of the bolt 40 to keep the bolt from rotating once it is seated by pressing its stops into the material of the wall 44 (for example wood). The nut 42 can also be provided with a flange or head 48 so that it does not become pulled into the material of the side wall 44. The shaft of bolt 40 can also be internally threaded.

In case the hole 47, which is designed to receive the anchoring structure is not to be used, it can be covered by a snap-on disk 49 and snap-on cover 50, each having a plurality of resilient prongs 52 or 53 which engage by friction with the inner surface of hole 47 or the outer surface of the bolt head 55. This forms a finishing button to decoratively cover the opening, in case the opening is to be exposed during use of the furniture.

Returning to FIG. 2, the feet 32, are each positioned immediately at the end of the core element. The outer portions of feet 32 have an upwardly open receptacle for receiving a foot plate 33 provided on the inner surface of arm module 30, for each foot 32 at one side of the core element. Feet 32 and foot plates 33 are thus fixed in position with respect to each other. This helps transmit load from the arm module 30 to the floor in case someone sits on the arm module. Alternatively, feet 32 can extend slightly beyond the end of core element 10 and each arm module 30 can be provided with a lower support plate which can rest on the extending portion of feet 32, again for providing vertical support for the arm module.

Figure 4:
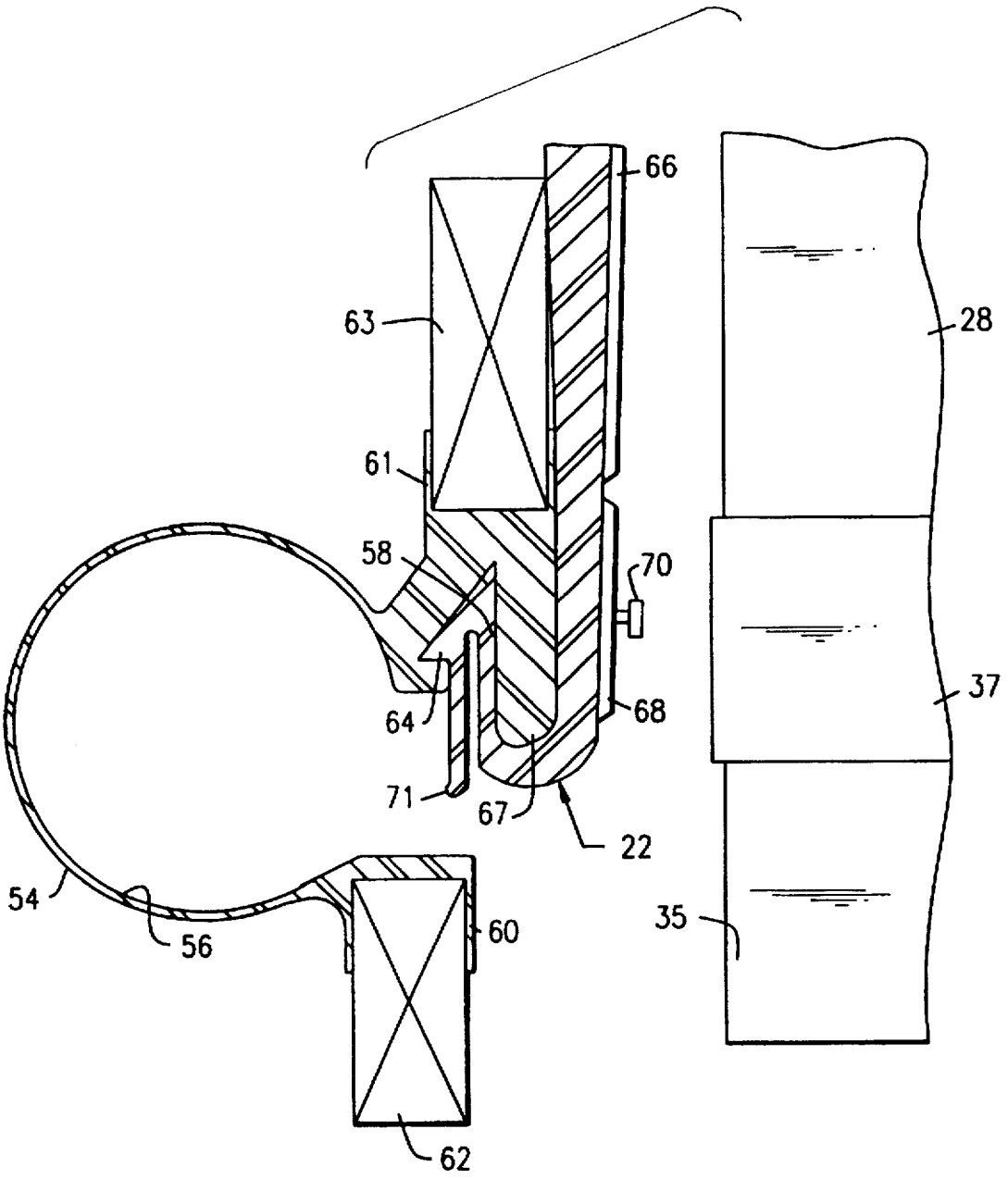
FIG. 4 is an enlarged detail of a section of the core element.

Referring now to FIGS. 3 and 4, means are provided at intersection 16 for holding the lower front edge of the back cover module 20. This is in the form of an elongated, preferably plastic extrusion 54 having a C-shaped cross-section and forming a large cylindrical channel or pocket 56 in its center with elongated arrowhead shaped notch 58 at one of its open edges. Both open edges are also formed with a pair of U-shaped rails 60 and 61 for embracing and being fastened to a pair of horizontal beams 62 and 63 which form part of the frame structure in the core element 10. Fastening of the rails to the beams can be achieved using screws, nails, staples or other known means.

Figure 9:
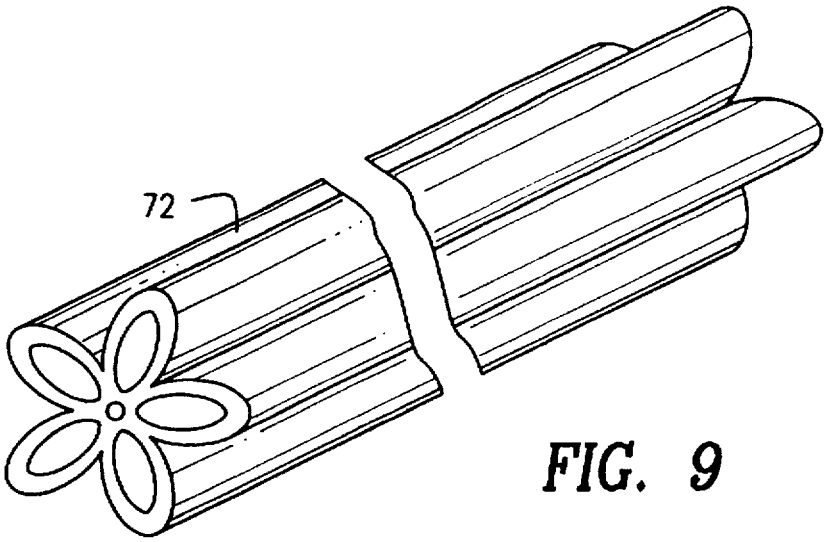
FIG. 9 is a perspective view of a baton for use in conjunction with channels or pockets in the system for holding a slipcover onto the system.

As best shown in FIG. 4, the notch 58 is shaped to receive, in a removable snap-fit fashion, an elongated arrow-head shaped fitting 64 integrally formed with or attached to the lower front edge 22 of the back cover module. The structure can advantageously be made of flexible plastic or other flexible material and may be covered, for example, with fabric 66 for the purpose of appearance. A fastening strip 68 also extends across an outer surface of front edge 22, and carries fasteners such as buttons 70, which can be used for fastening an edge of a slipcover to be used in conjunction with the furniture system. Alternatively, the cylindrical channel 56 in the extrusion 54 can be used to receive a flexible baton that is pushed into a part of a tucked-in slipcover and is inserted into the channel. An example of the baton is shown at 72 in FIG. 9 and may be a star or daisy shaped extrusion of plastic foam material which has the required resiliency so that it can be pressed into the intersection area and squeezed into channel 58.

In addition to the U-shaped rails 60 and 61 at the opposite ends of the extrusion 54, one end of the extrusion which carries the notch 58 also carries an elongated nose portion 67 around which the flexible edge 22 is wrapped as shown at FIG. 4. Nose portion 67 helps further fix the lower edge 22 so that it is not inadvertently pulled out of notch 58, during use of the furniture. The resiliency of fitting 64, which contains a recess and has a finger release 71, permits the fitting to be pulled out if release 71 is pushed to the right in FIG. 4 and downward force is applied, in order to change the back cover module.

A frame element 35, for example made of wood, for the seat portion 12 and upholstered support springs and cushion, schematically at 37, of the seat portion are also shown in FIG. 4.

Figure 7:
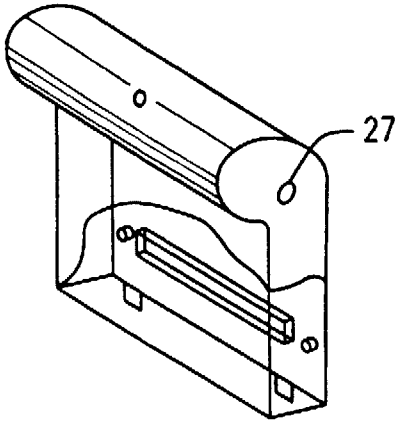
FIG. 7 is a view similar to FIG. 6 of a still further embodiment of the arm module.
Figure 6:
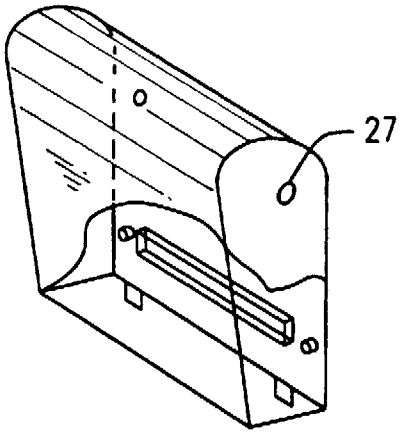
FIG. 6 is a perspective view with portions cutaway, of an alternate arm module of the present invention.

As an alternate to utilizing a separate arm module 30 with arm cover module 24 as shown in FIG. 1, FIG. 6 and 7 show alternate embodiments of arm modules which are fully shaped and muslin upholstered before they are attached to the core element. FIGS. 6 and 7 illustrate the presence of one or more arm front fasteners 27 provided on the front and rear surfaces of the module for receiving accessories to be described later in this disclosure.

Figure 8:
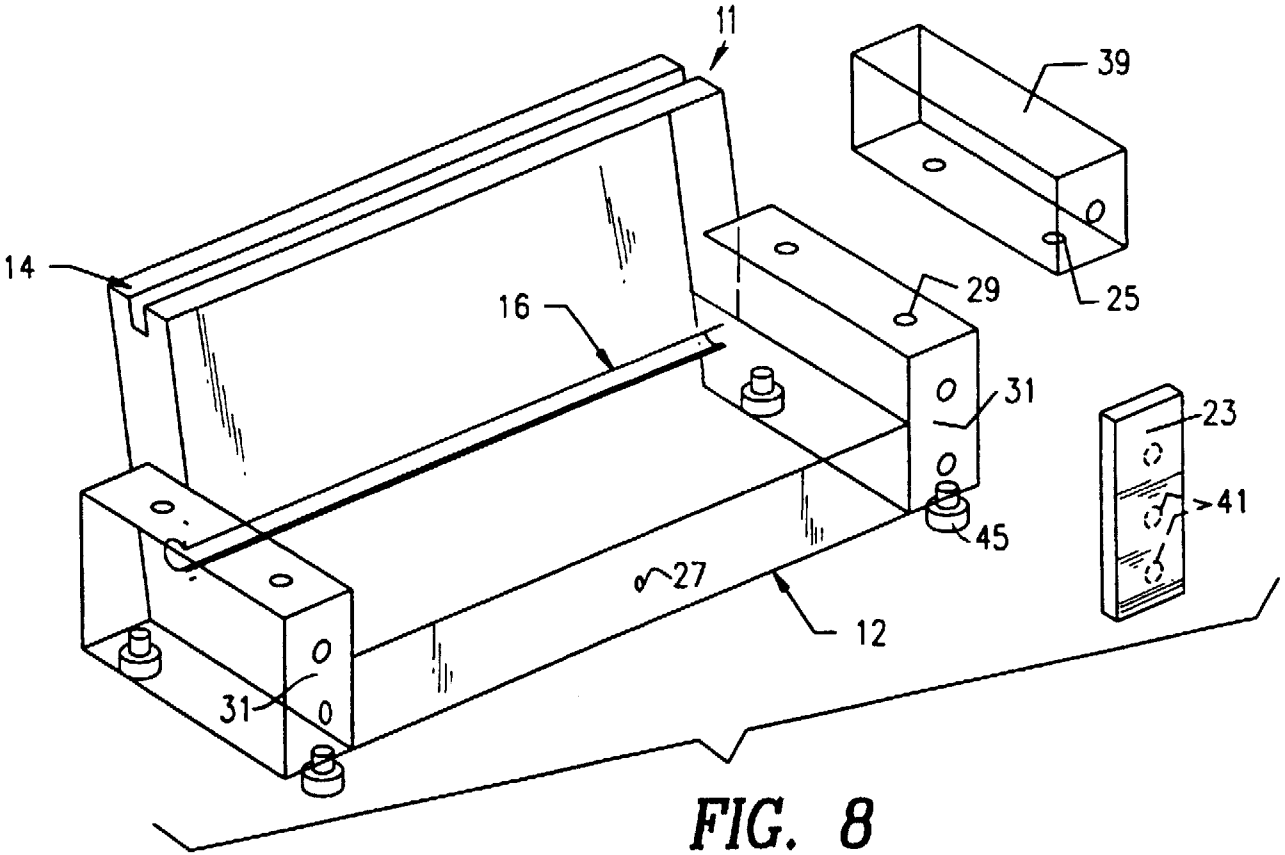
FIG. 8 is an exploded view of a second embodiment of furniture system with integrally connected lower arm portions, connected to the core element.

FIG. 8 illustrates another embodiment of the present invention which utilizes a slightly modified core element generally designated 11 which, like the embodiment of FIG. 1, includes seat and back portions 12, 14 which are connected to each other to form a single structural unit, with an intersection 16 containing first cover holding means for holding the lower front edge of a back shaping module. Unlike the embodiment of FIG. 1, however, FIG. 8 includes integrally formed lower arm portions 31 which are also formed as a single, non-detachable structural unit with the seat and back portions 12, 14.

Throughout the figures of this disclosure, the same reference numerals will be utilized to designate the same or functionally similar parts.

Figure 10:
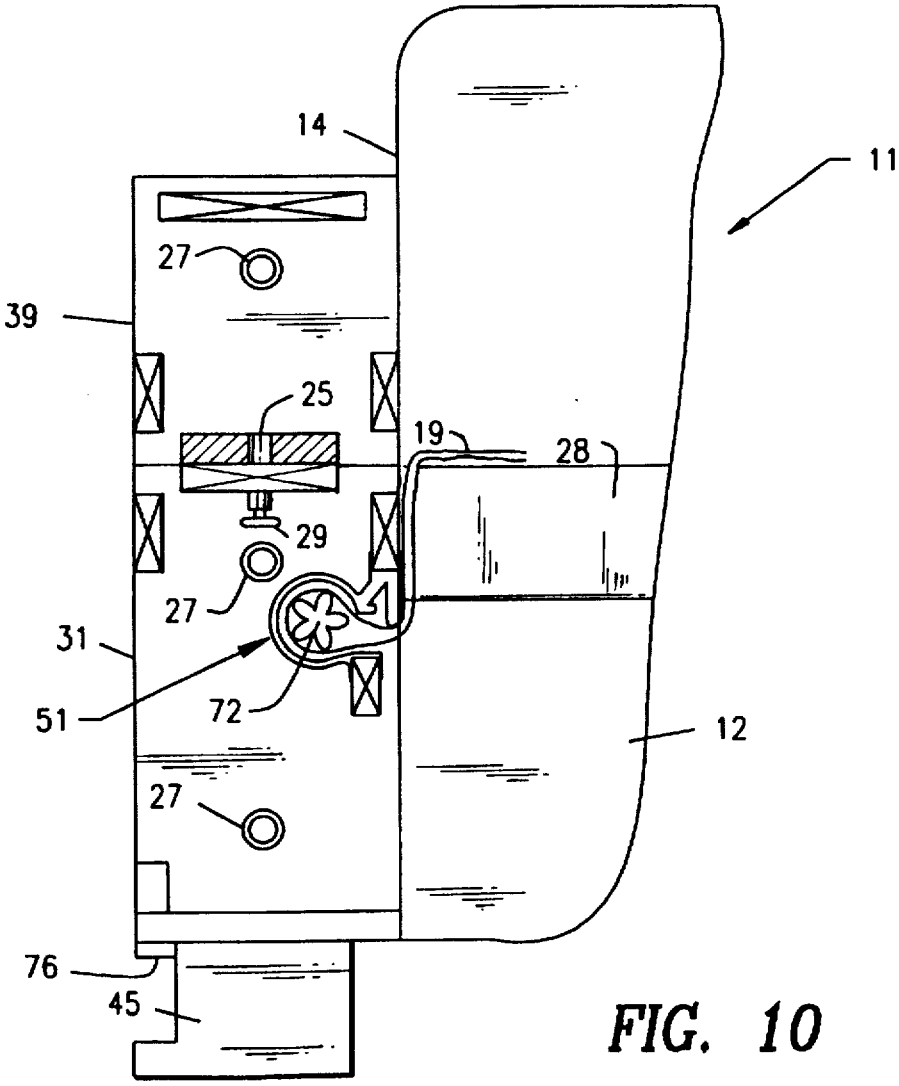
FIG. 10 is a partial front view with portions exposed, of the embodiment of FIG. 8.

In the embodiment of FIG. 8, the appearance of the furniture system can be changed by adding different upper arm modules 39, which can be attached to the upper surface of the lower arm portion 51, for example, using a captured screw 29 which can be threaded into a threaded hole 25 on the under surface of module 39 shown in FIG. 10. As with the embodiment of FIG. 1, arm front (or rear) cover panels 23 can be attached by pins or posts 41 to fasteners 27, e.g., capture holes, in the arm members.

FIG. 10 shows this structure in greater detail. As with the embodiment of FIG. 1, the embodiment of FIGS. 8 and 10 also include cushions 28 on the upper surface of the seat portion 12. Also see in FIG. 10, slipcover 19 tucked into the intersection between seat portion 12 and arm portion 31, and baton 72 holding the tucked slipcover, into the channel of member 51. Arm front fittings 27, as detailed in FIG. 5, for example, one in the arm module 39 and two in the arm portion of 31, can also be utilized to receive accessories.

Another difference between the embodiments of FIGS. 1 and 8 is use of legs 45 which extend from the lower surface of the arm portion 31, at the front and the back of the core element 11, for supporting the entire structure.

In order to secure removable modular arm shapers to the embodiment of FIGS. 8 and 10, edge holding means generally designated 51, which is virtually identical in structure to the extrusion 54 and its related parts, is provided in the body of the arm portion 31. Structure 51 can be used to capture the lower edge of the inner surface of the arm shaping module, for example, the lower edge 26 of cover module 24 shown in FIG. 1.

Figure 11:
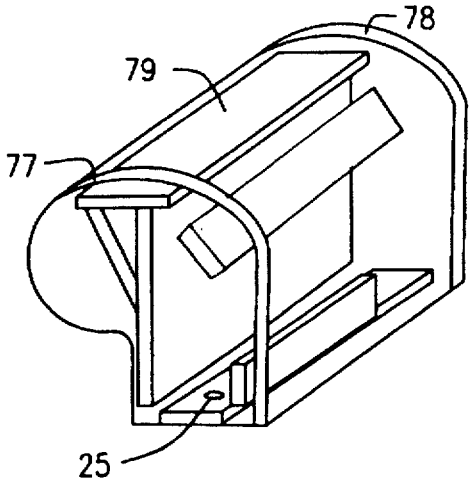
FIG. 11 is a perspective view with underlying structures exposed, of an alternate embodiment for an upper arm module for the embodiment of FIG. 8.
Figure 12:
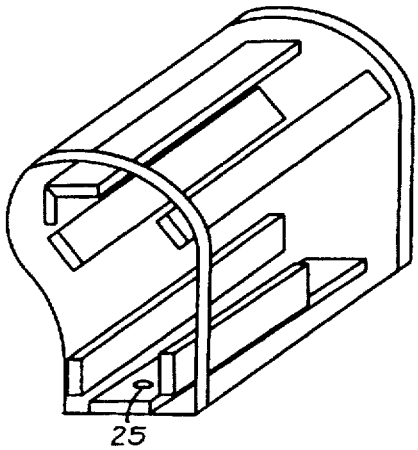
FIG. 12 is a view similar to FIG. 11 of another embodiment of the upper arm module.

It is noted that the outer lower edges 73 and 74 of the respective arm and back shaping modules 24 and 20 can be provided with fasteners such as hook-and-loop fasteners, which can be mated with corresponding fasteners on the bottom of the core element or arm portion or module of the invention. Such a mating fastener is shown for example at 75 in FIG. 3 and 76 in FIG. 10. FIG. 11 illustrates a framed upper arm module having an alternate shape and internal framing and bracing. The outer fabric covering is transparent in the figure in order to reveal the structure of the arm module. It may, for example, include front and rear walls 77, 78 which are spanned by supporting beams 79 and then covered by padding and fabric. A different embodiment of the upper arm module is shown in FIG. 12. This illustrates the drastic difference in appearance which is possible according to the present invention, simply by changing the modular elements.

Figure 13:
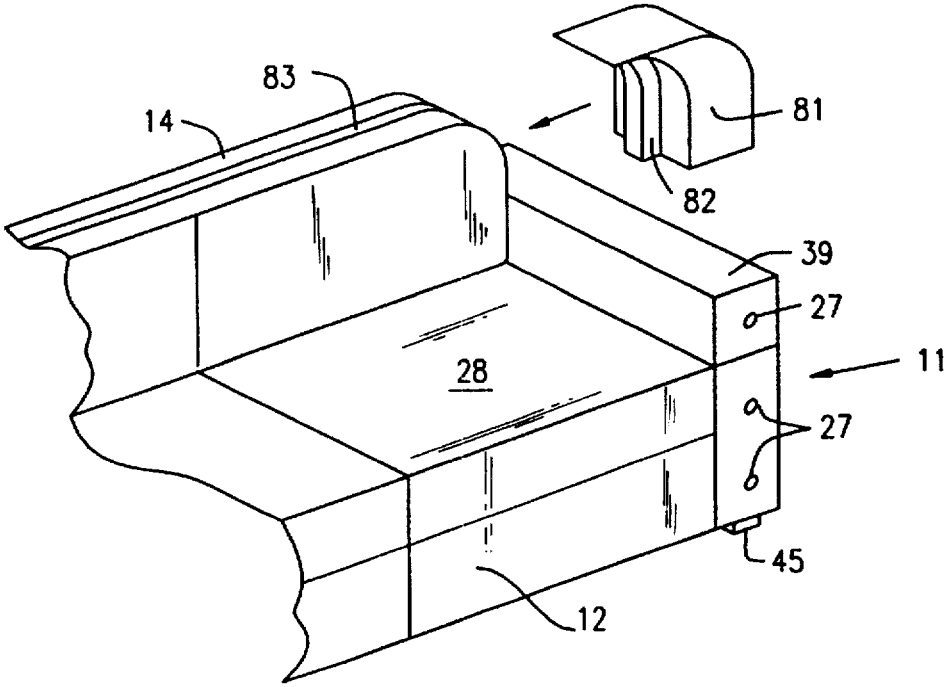
FIG. 13 is an exploded view of another embodiment of the invention including side extensions for the back of the core element.

FIG. 13 shows another embodiment of the invention which includes side modules 81 with an internal rib 82 adapted to engage a groove 83 in the back portion 14. The back portion 14 in the embodiment of FIG. 13 is curved to receive the curved inner surface of the side module 81, again to drastically change the appearance of the furniture. This can be further done by adding arm modules and differently shaped cover modules over the arms and back of the furniture.

Figure 14:
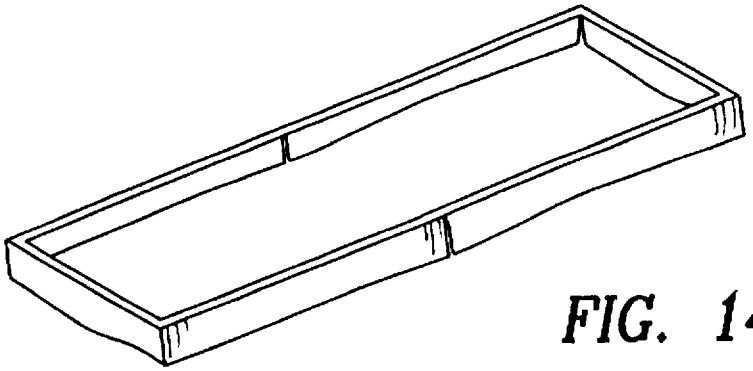
FIG. 14 is a perspective view of one embodiment of a skirt which can be used in conjunction with the invention.
Figure 15:
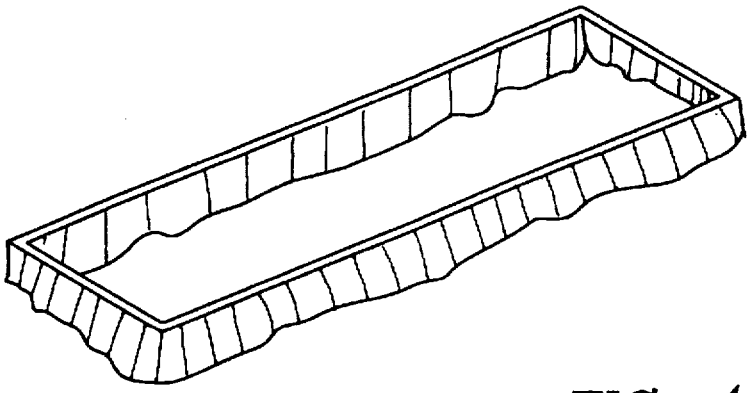
FIG. 15 is a view similar to FIG. 14 of another embodiment of the skirt.

FIGS. 14 and 15 illustrate skirts which can be attached, for example, with hook-and-loop tape, near the lower edge of the furniture system after all desired modules and slipcovers have been installed. This conceals the feet 32 or 45 if desired.

Figure 16:
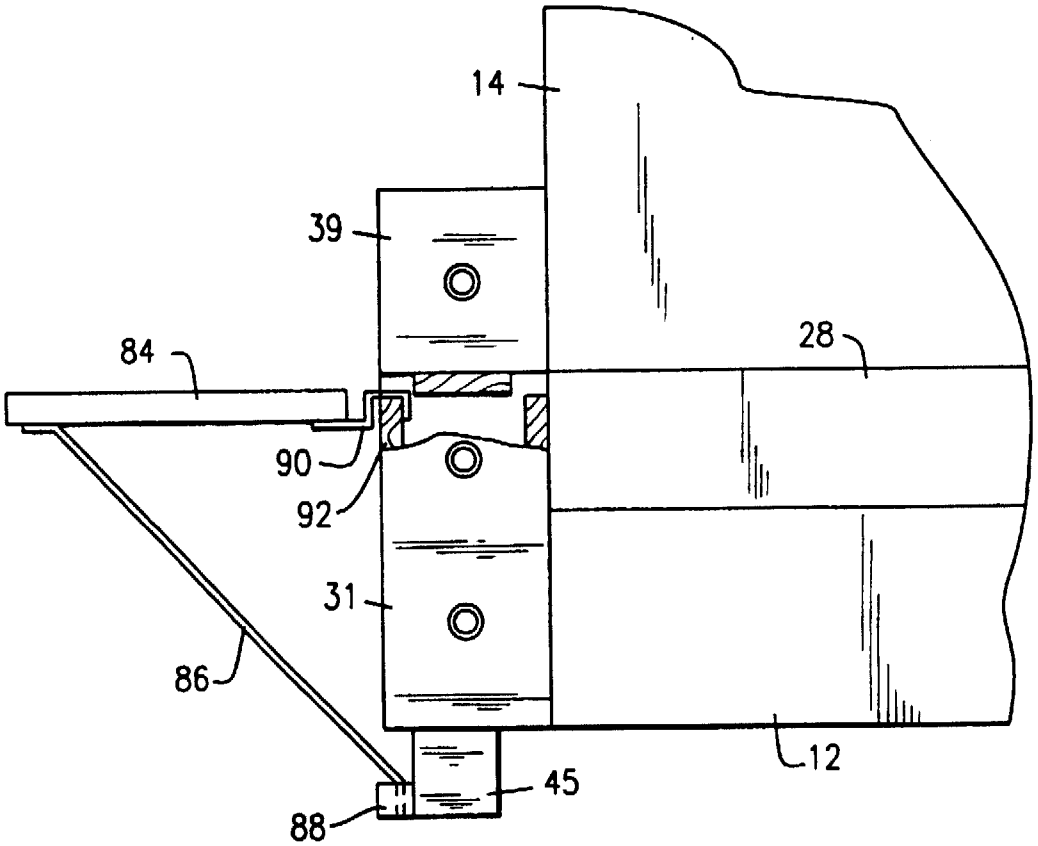
FIG. 16 is a partial front view with portions cut away, of an arrangement for a side mounted arm table according to the present invention.

FIG. 16 illustrates a side mounted arm table 84 having a pair of lower supports 86 which extend from the under surface of the outer edge of table 82, into a suitably shaped recess or slot on a side extension 88 of the foot 45. The inner edge of table 84 is provided with a bracket 90 of bent metal for example, fastened to the under surface of the table and hooked over a beam 92 forming part of the frame of the lower arm portion 31. This can be achieved by leaving a slit in the fabric covering of lower arm portion 31.

Figure 17:
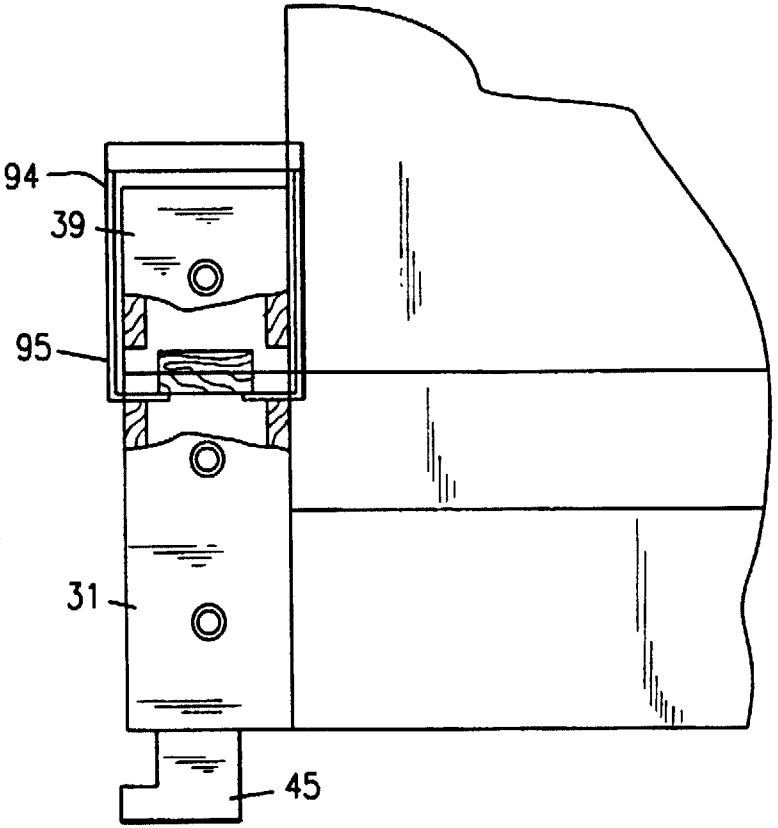
FIG. 17 is a view similar to FIG. 16 of a top mounted arm table.
Figure 18:
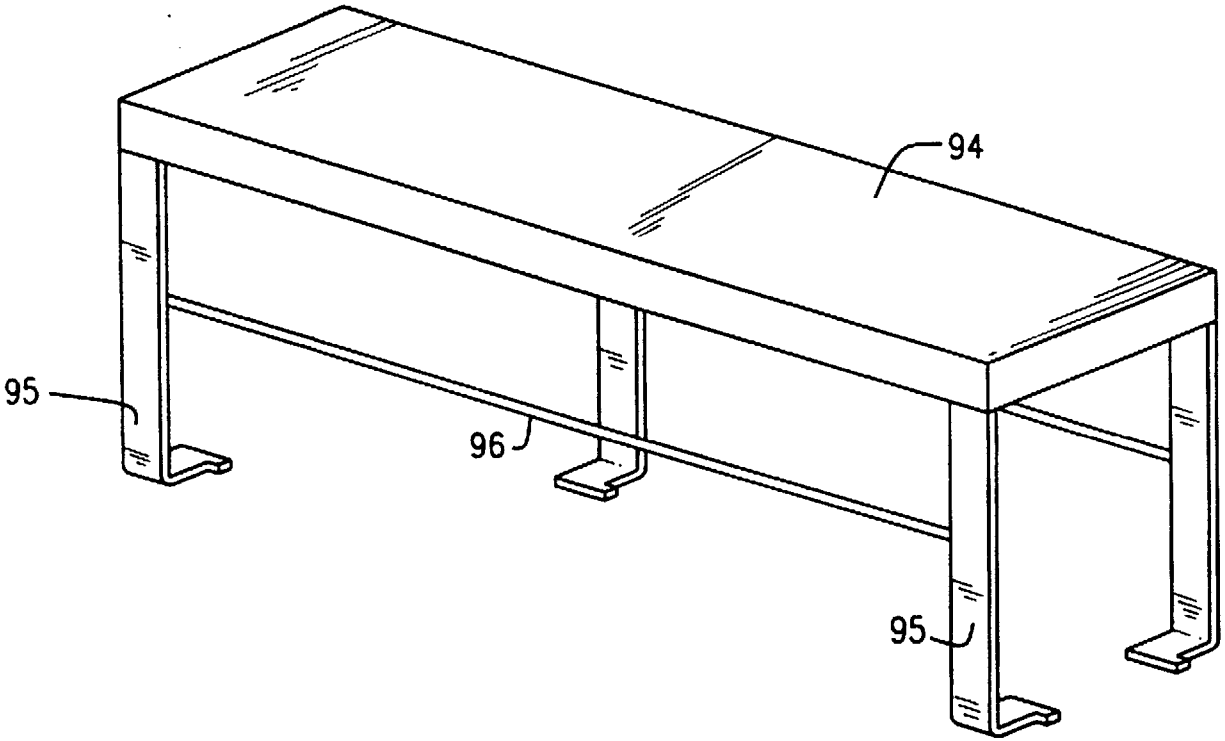
FIG. 18 is a perspective view of the top mounted arm table.

This also takes advantage of the opening area between the fixed lower arm portion 31 and the modular upper arm portion 39. FIG. 17 illustrates a top mounted arm table 94 having four leg hooks 95 which have a lower bent end that engage under a frame element at the upper end of the lower arm portion 31. FIG. 18 also illustrates the use of a bar 96 between leg hooks 95 on each side of the table 94, for supporting the leg hooks. The bars 96 on either side of the table can also be lower, to the point where the lower ends of the leg hooks are bent, so that they can be covered with a flap of cloth provided either on the modular upper arm 39 or the structurally integrated lower arm portion 31.

Figure 19:
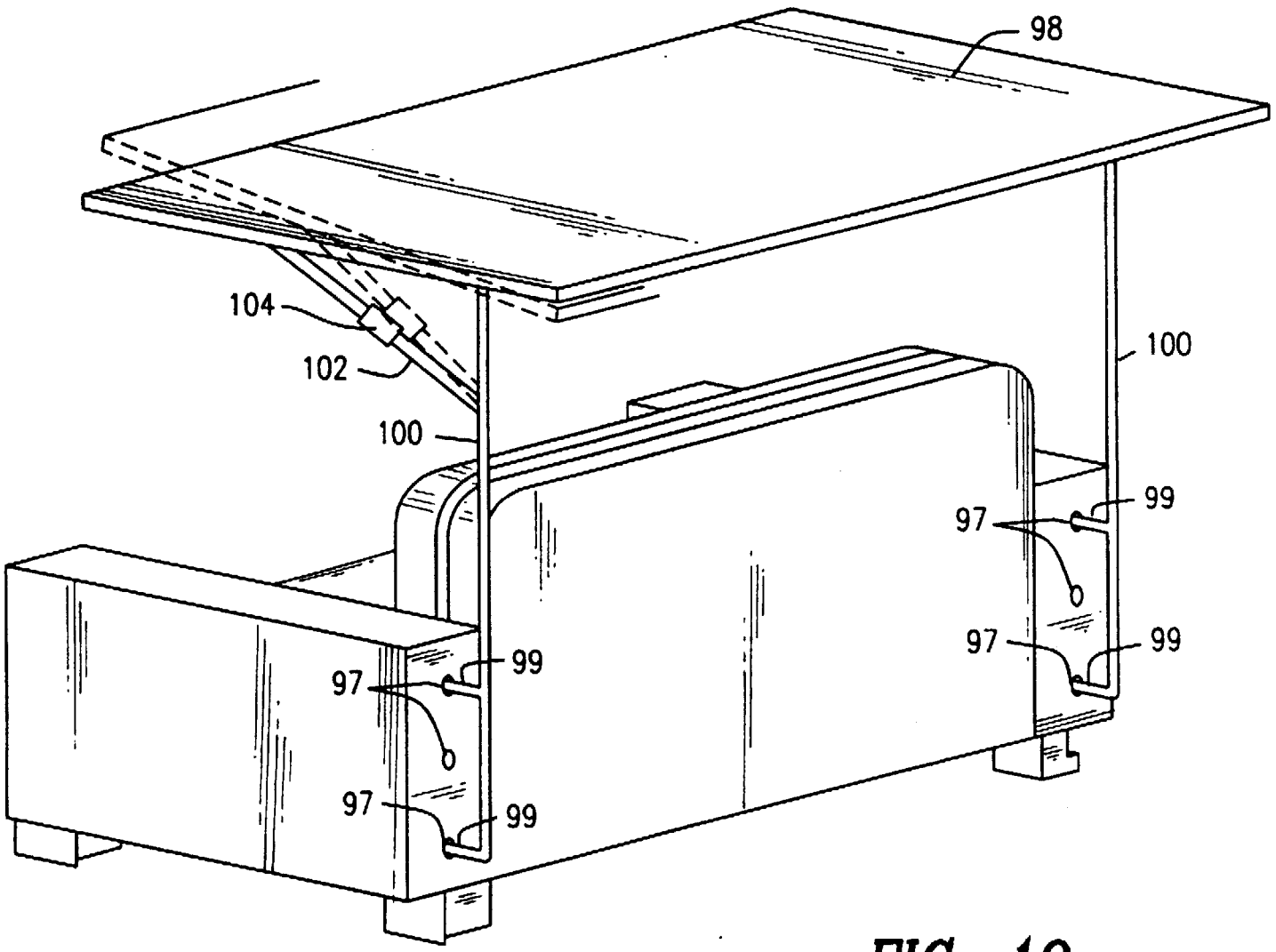
FIG. 19 is a perspective view of a canopy module used in conjunction with the invention.

FIG. 19 illustrates a sun shield or canopy 98, made for example of flexible or rigid sheet material, for covering the furniture.

Anchor assembly recesses 97 (see FIG. 5 for the anchor) are provided at the rear surface of the arms of the modular furniture for receiving inwardly bent or extending posts 99, extending inwardly from vertical supports 100. An angled support 102 which is advantageously provided with a turn buckle or other length changing mechanism 104, extends at an angle between the vertical supports 100 and the undersurface of canopy 98, for adjusting the angle of the canopy, for example as shown in phantom line in FIG. 19.

Figure 20:
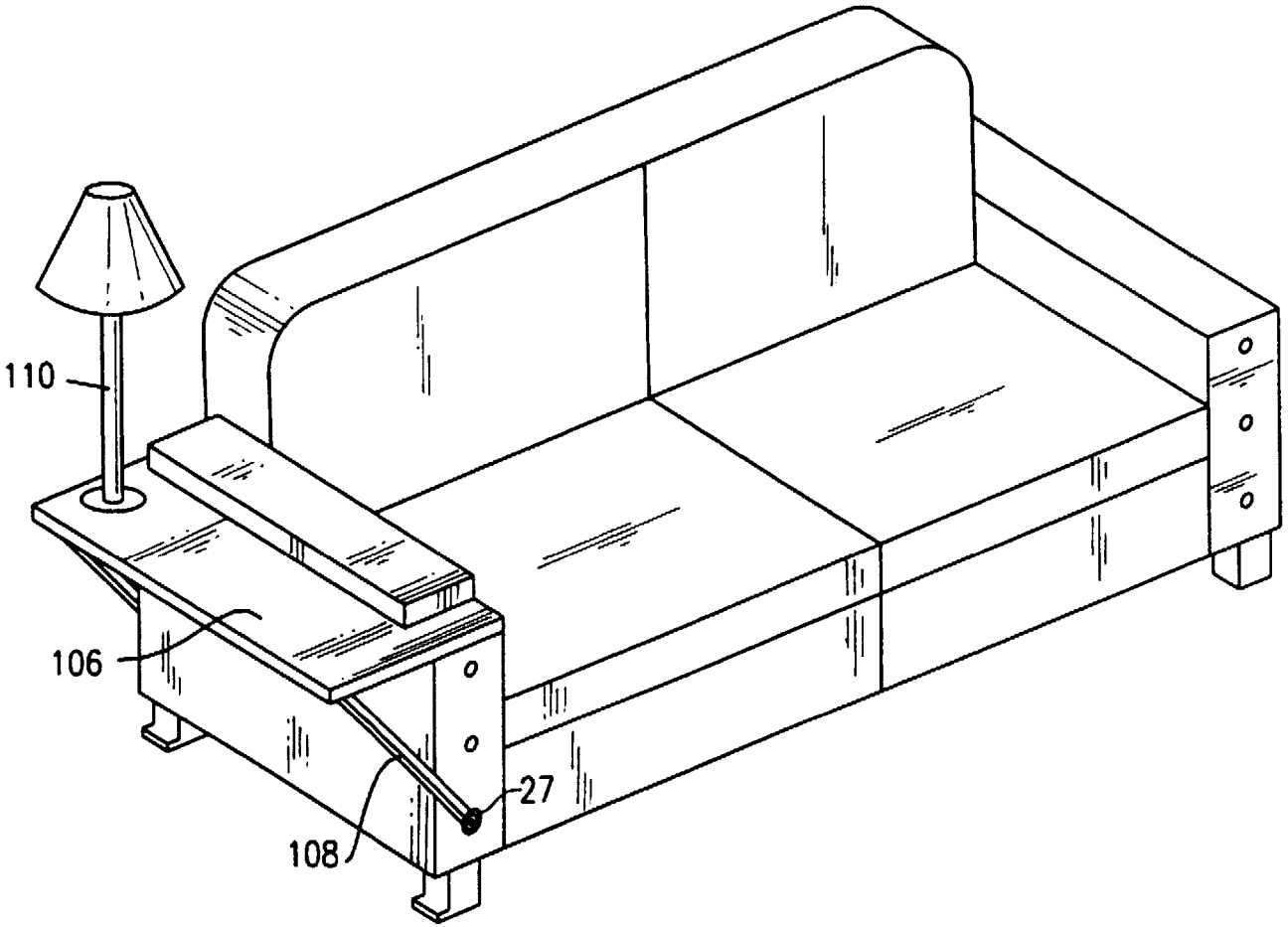
FIG. 20 is a perspective view of a side table and lamp used with the present invention.

FIG. 20 illustrates another embodiment of the invention which includes a side table 106 that is connected between the upper and lower arm segments, and which is supported by angled supports 108 having one end attached to the under surface of the table, and an opposite end extending into one of the front fasteners 27. A lamp 110 may be formed as a part of table 106.

Figure 21:
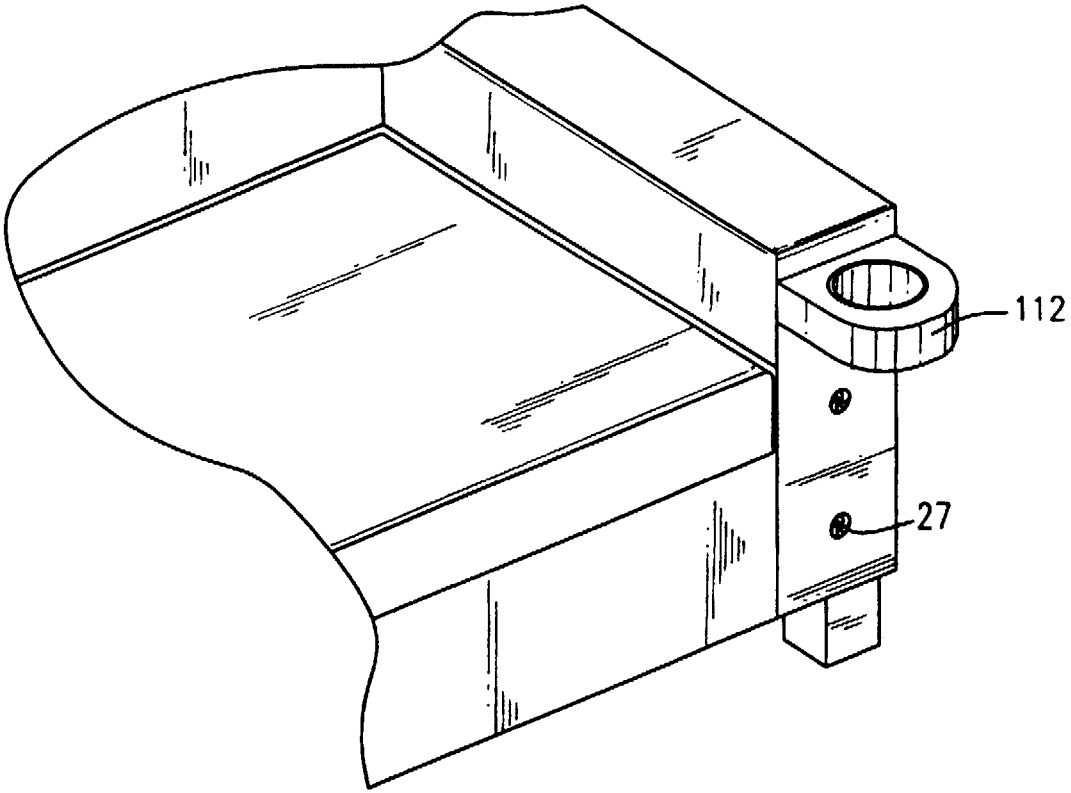
FIG. 21 is a partial perspective view of a cup holder accessory of the present invention.
Figure 22:
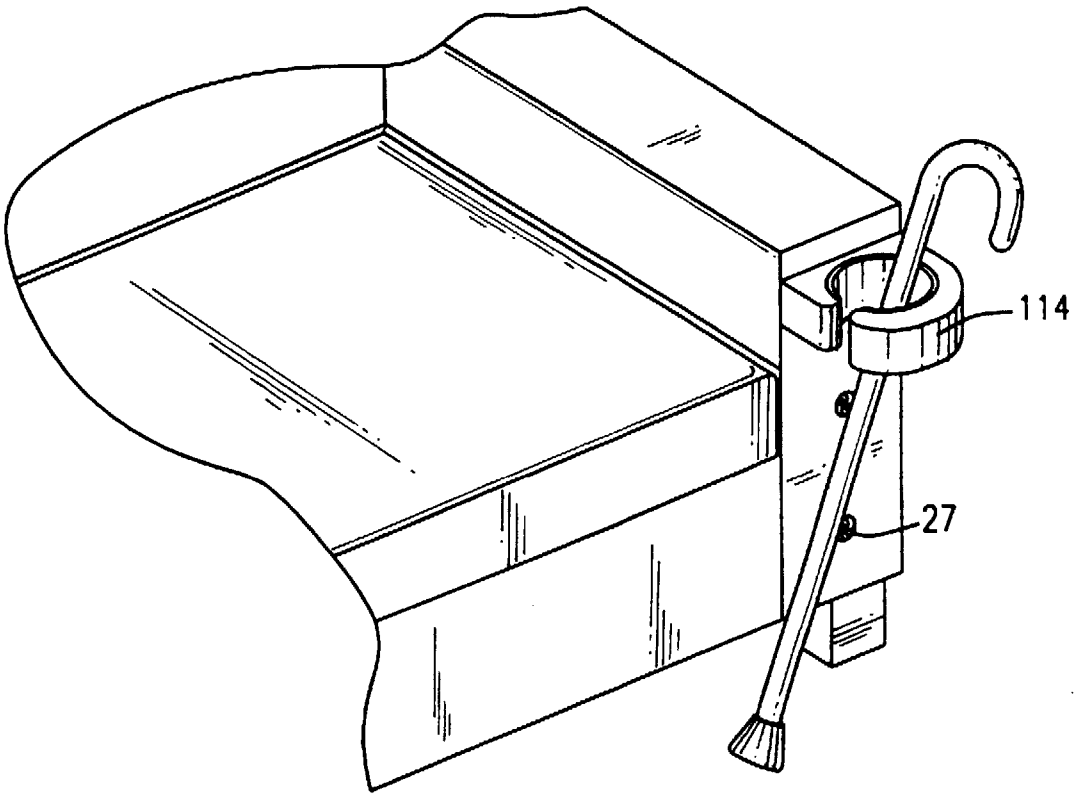
FIG. 22 is a view similar to FIG. 21 of a walking cane accessory.

FIG. 21 shows another use for the arm front fasteners 27, specifically for a snap-in cup holder 112 or in the case of FIG. 22, a snap-in cane hook 114.

Figure 23:
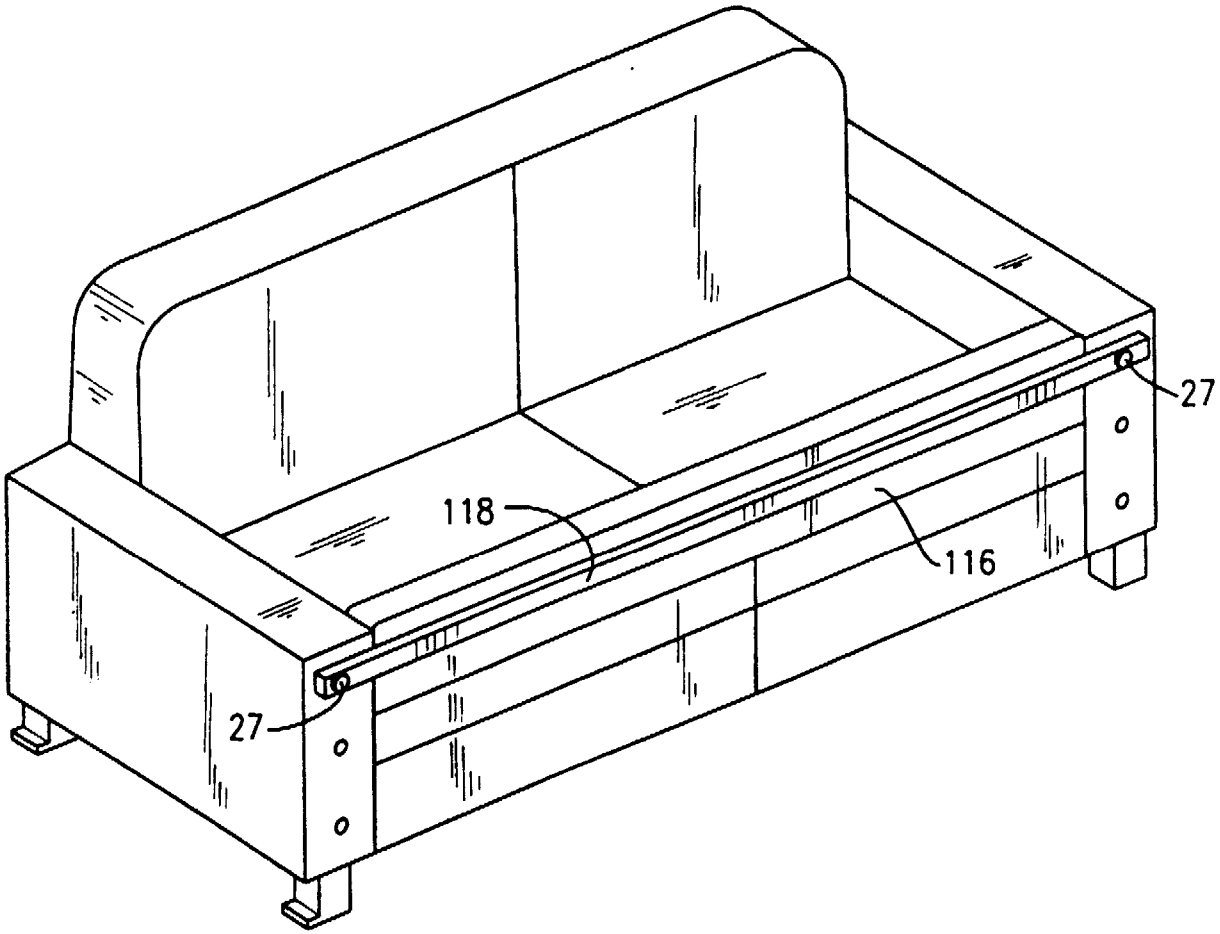
FIG. 23 is a perspective view of a bolster accessory of the present invention.

As shown in FIG. 23, an upper pair of fasteners 27 can also be used to detachably secure the support beam 118 fixed to the rear surface of a bolster 116, to convert the sofa to an infant bed. The ends of beam 118 may also be shaped to be inserted into one of the anchor nuts 42 at the upper, inner corner of the arm.

Figure 25:
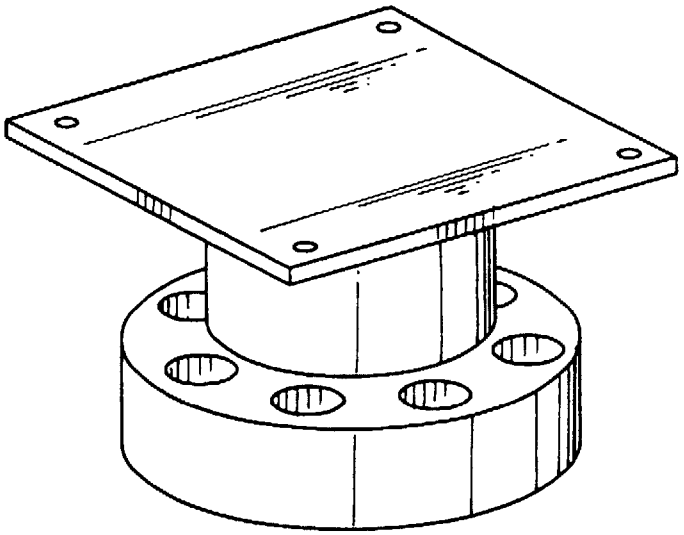
FIG. 25 is a view similar to FIG. 24 of another embodiment of the foot.
Figure 24:
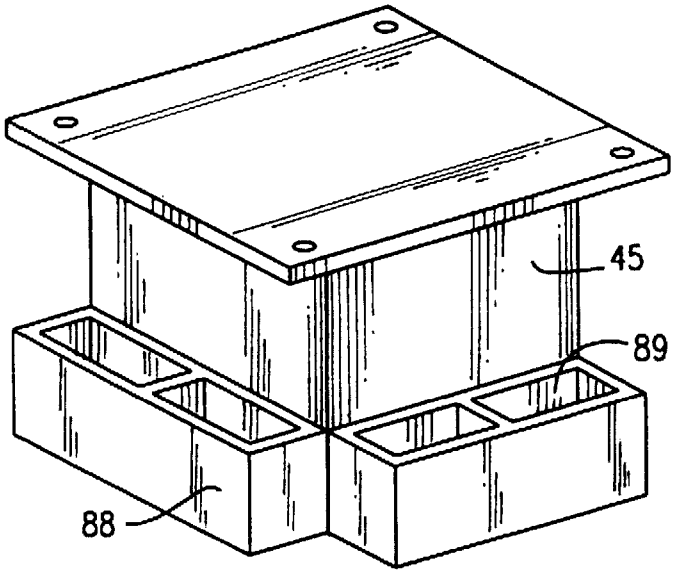
FIG. 24 is a perspective view of an alternate embodiment of the foot of the present invention.

FIG. 24 shows one form of foot 45 having both a side extension 88 and a front extension 89, both with upwardly open recesses for receiving supports, rods or other accessory mountings. FIG. 25 shows an alternate embodiment of the foot which has circular recesses for receiving rod shaped supports.

Figure 26:
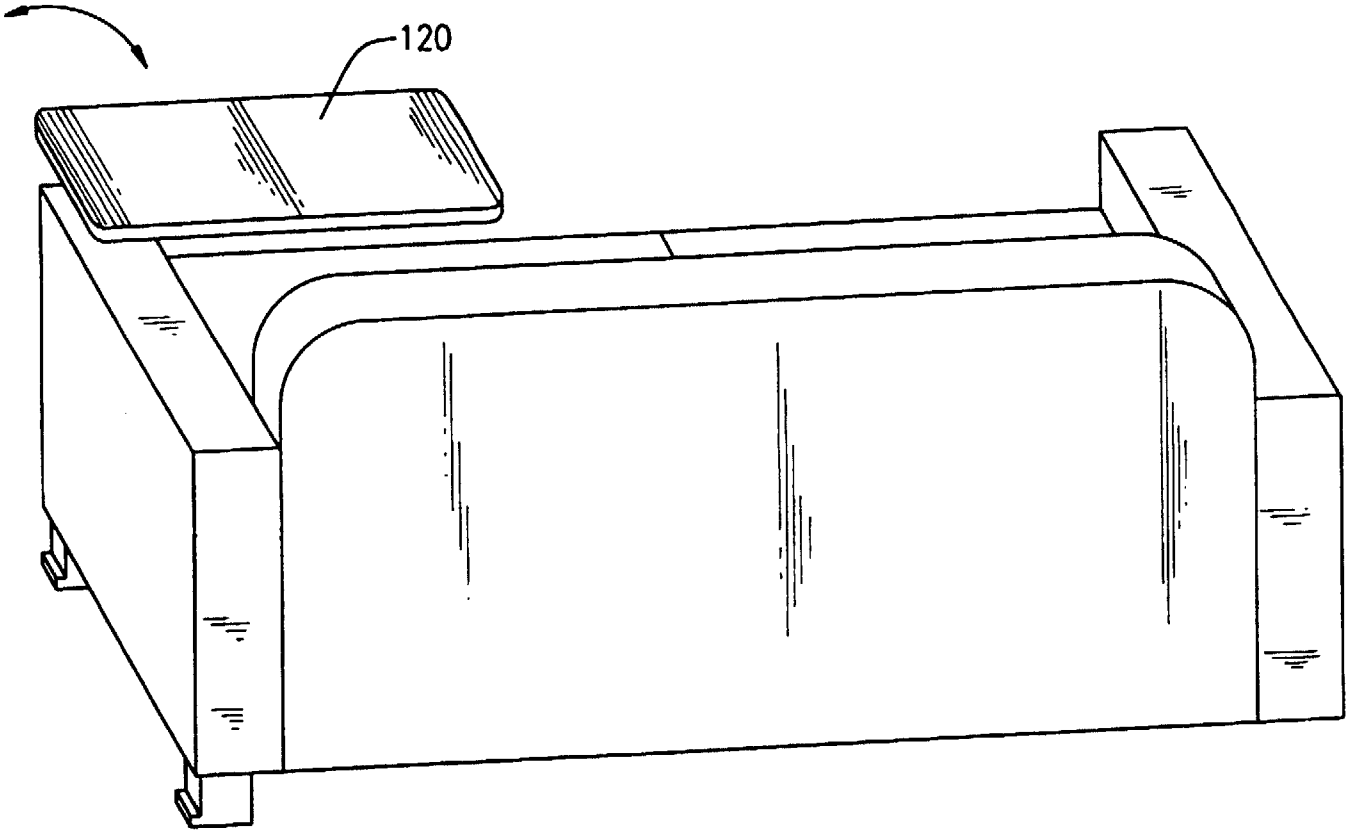
FIG. 26 is a perspective view of a pivoting arm table or tablet of the present invention.

FIG. 26 illustrates a pivotable tablet or table 120 which can be pivotally mounted to the front surface of one of the arms to move into any desired position around the pivot point.

Figure 27:
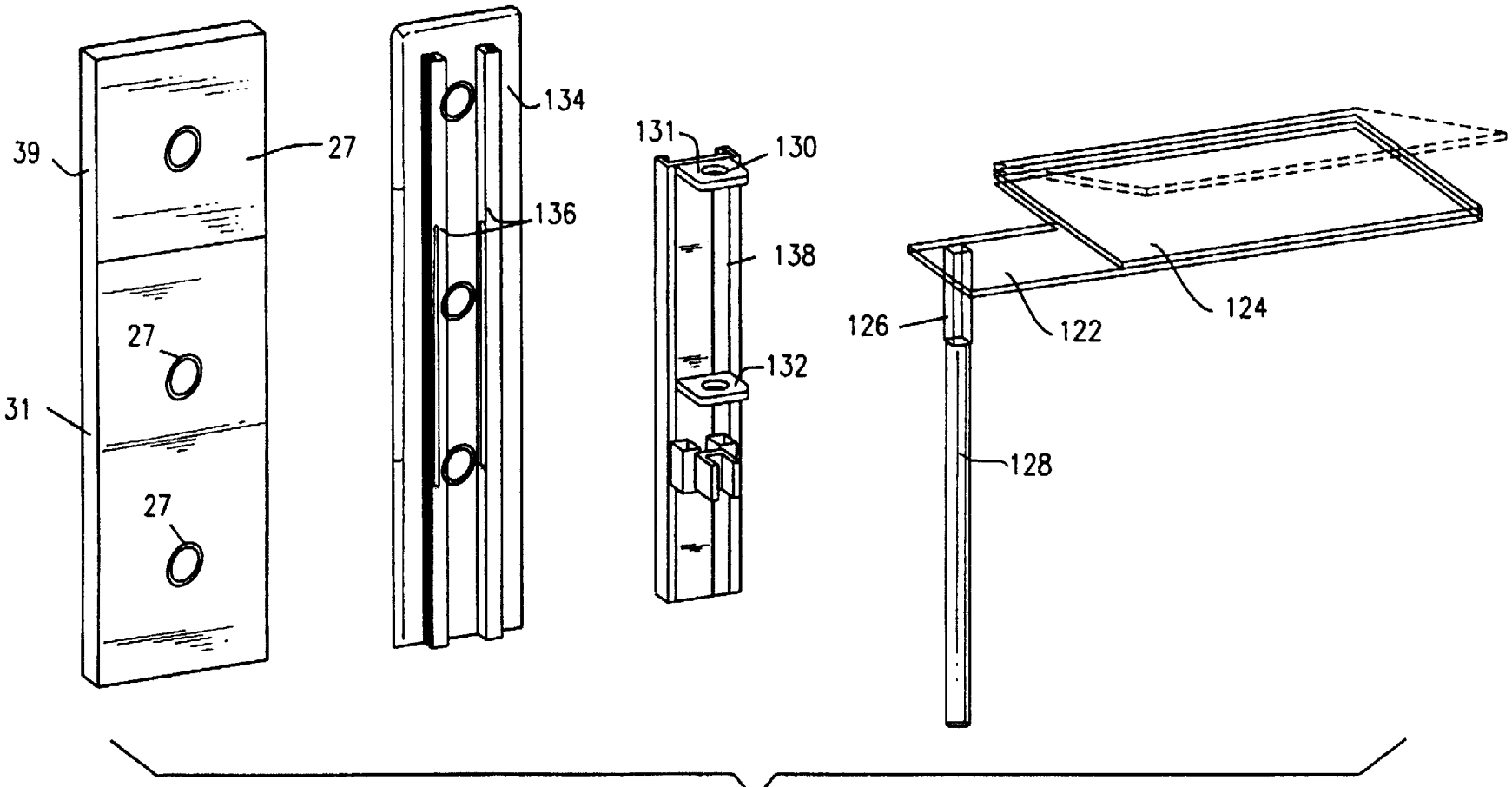
FIG. 27 is an exploded view of an alternate embodiment of hardware for mounting a pivoting arm tablet according to the present invention.

One example is shown at FIG. 27, where an L-shaped table 122 which also includes a hinged table extension 124 that can be pivoted in the direction of the phantom lines to increase the surface area or the working angle of the table. A cylindrical cup 126 is fixed to the lower surface at one end of table 122 and receives a cylindrical post 128 which is long enough to extend to the floor. Post 128 is pivotally received within holes in a pair of guides or journals 130, 132, upper guide 130 having a star shaped opening 131 for receiving the outer surface of cup 126 which is also provided with star projections to prevent pivoting of the table once it has been placed into a desired position. Placement into position is achieved by lifting the table and cup, rotating it by 90°, 180° or another multiple of 90°, into a desired position, and then dropping the cup into the hole 131 where one or more of the projects on cup 126 engage one or more of the notches in opening 131.

Figure 28:
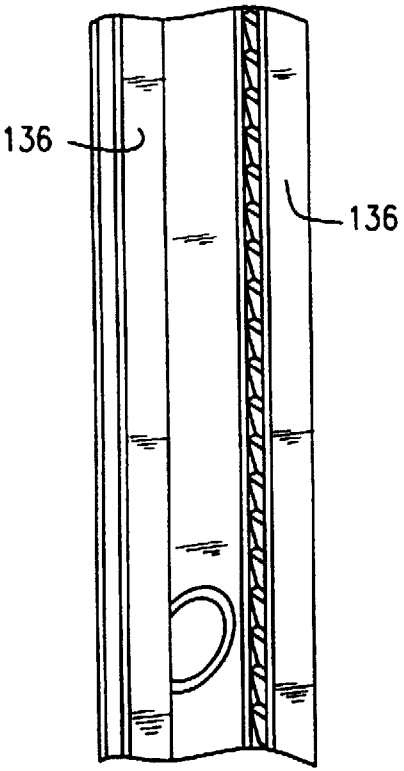
FIG. 28 is a partial perspective view of a channel forming part of the tablet hardware.

Only the front surfaces of the arm portions 31 and 38 are shown, each with a fastening recess 27 that can be used with screws or other fasteners for attaching the ornamental plate of a channel member 134 over the front of the arms. Channel member 134 includes a pair of toothed rails 136 each having inwardly directed sawtooth recesses best shown at FIG. 28. The guides 130, 132 are fixed to the outer surface of a slide member 138 which embraces the outer surfaces of rails 136 to permit vertical sliding between elements 138 and 136, but no lateral movement.

Figure 29:
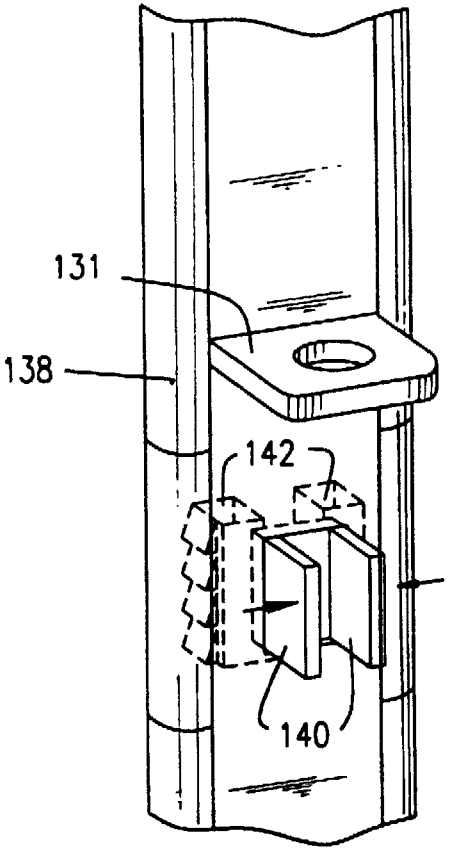
FIG. 29 is a partial perspective view of a slide forming part of the hardware.

The vertical position between slide 138 and rails 136, which also fixes the vertical position of table 122, is selected by squeezing together ears 140 which are attached to detente members 142 best shown at FIG. 29, to disengage sawtooth projections of the detente members from the rail projections to permit vertical movement of the slide 138.

The shape of the sawtooth projections and the sawteeth in rails 136 is selected to preclude downward sliding but to permit upward movement by pressing the bars together against the bias of a spring or springs that hold the detente members apart.

Figure 30:
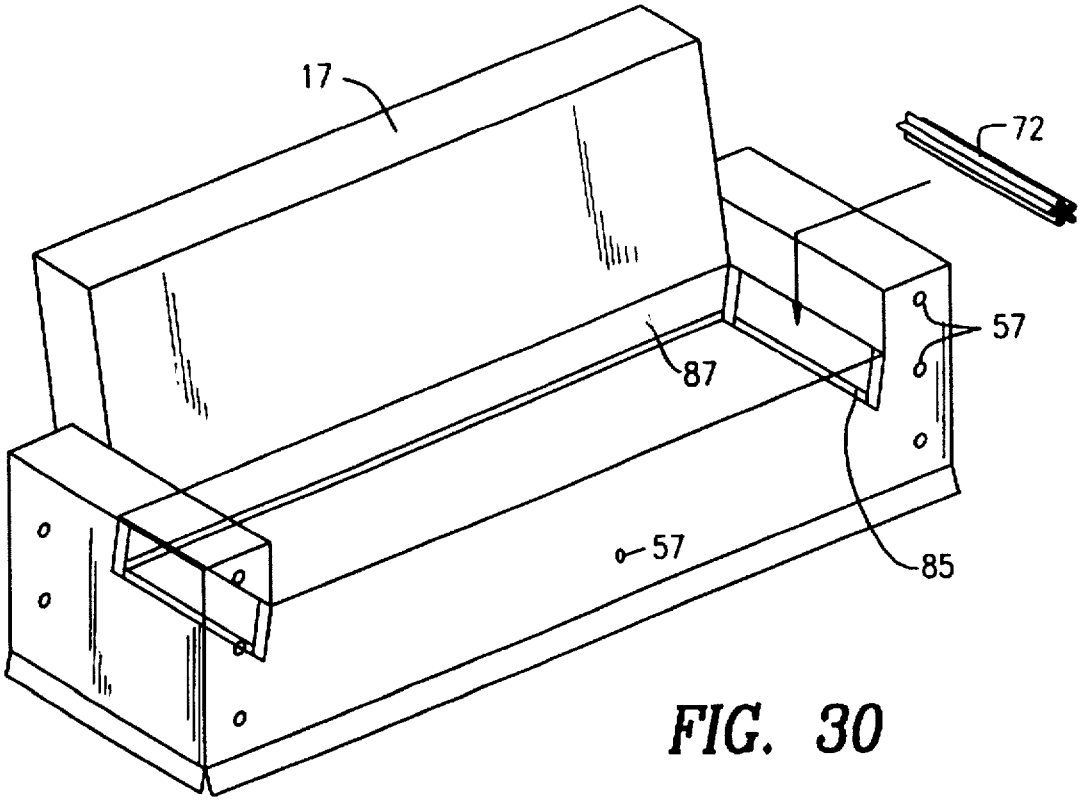
FIG. 30 is a perspective view of a specially designed slipcover of the invention.

FIG. 30 illustrates a specially structured slipcover 17 of the present invention, having back, seat and arm sections tailored to closely fit a core and attached arm module of the present invention, with or without arm and back shaping modules. Strategically located holes 57 are provided in the slipcover 17, corresponding with the fittings 27 and 97 for receiving accessories according to the present invention. Another unique feature of the slipcover 17 is the existence of side and rear pockets 85, 87, which comprise extensions of cloth in the intersection areas of the furniture system, for receiving a baton 72 into each pocket which, in turn, is pressed into a corresponding channel to fit the slipcover to the system to such an accurate and well anchored extend that the furniture appears to be a fully upholstered seating as opposed to a seating using slipcovers. The cushions are advantageously upholstered with the same fabric and placed over the now covered system.

While specific embodiments of the invention have been shown and described in detail to illustrate the application of the principles of the invention, it will be understood that the invention may be embodied otherwise without departing from such principles.

What is claimed is:

1. A shape changeable furniture system comprising:

an L-shaped core element having a horizontally extending seat portion and a vertically extending back portion connected to and forming a single non-detachable structure with said seat portion, said seat and back portions being non-detachably connected to each other at an elongated intersection, said core element having opposite ends;

a back shaping module detachably connected to said core element and extending over said back portion, said back shaping module having a front lower edge extending to said intersection;

first shaping module holding means at said intersection for holding the front lower edge of said back shaping module to the intersection of said core element;

at least one arm module detachable connected to one of said opposite ends of said core element, said arm module comprising a full arm module which extends from a lower end of the seat portion to an upper arm rest level; and a groove connected to one of the core element and full arm module, and a rib connected to the other of the core element and full arm module for engagement into the groove for securing the relative positions between the core element and full arm module.

2. A furniture system according to claim 1, including a plurality of feet connected to a lower surface of the seat portion, at least some of the feet being near the opposite ends of the core element, the full arm module including feet engaging-means for supporting the full arm module at the feet.

3. A furniture system according to claim 2 wherein the feet engaging means comprises a foot plate connected to the full arm module for each foot of the core element at one of the opposite ends of the core element.

4. A furniture system according to claim 1 including a plurality of detachable anchors connected between the full arm module and the core element for detachably connecting the arm module to the core element.

5. A furniture system according to claim 1, including an arm shaping module detachably connected over said full arm module.

6. A furniture system according to claim 5, wherein the arm shaping module includes an inner lower edge and the arm module includes means for detachably holding the inner shaping module edge.

7. A furniture system according to claim 6 wherein the back shaping and the arm shaping modules both include outer lower edges, the system including means on the core element and on the arm module for holding the outer lower edges of the back and arm shaping modules respectively.

8. A furniture system according to claim 1, including means on the core element for detachably holding a rear, lower edge of the back shaping module.

9. A furniture system according to claim 1, wherein the arm module includes a front surface, the system including at least one arm front fastener on the front surface of the arm module for detachably connecting accessories to the arm module.

10. A shape changeable furniture system comprising:

L-shaped core element having a horizontally extending seat portion and a vertically extending back portion connected to and forming a single non-detachable structure with said seat portion, said seat and back portions being non-detachably connected to each other at an elongated intersection, said core element having opposite ends;

a back shaping module detachably connected to said core element and extending over said back portion, said back shaping module having a front lower edge extending to said intersection;

first shaping module holding means at said intersection for holding the front lower edge of said back shaping module to the intersection of said core element;

at least one arm module detachable connected to one of said opposite ends of said core element; and the first shaping module holding means comprising means defining a notch in the intersection for receiving a fitting, and a fitting at the front lower edge of the back shaping module, detachably received in the notch.

11. A furniture system according to claim 10, wherein the means defining the notch comprises an elongated C-shaped member fixed to the core element at the intersection and extending along the intersection.

12. A furniture system according to claim 10, wherein said arm module comprises a full arm module having a finished outward shape for an arm of the furniture system extending from a lower end of said seat portion to an arm rest level.

13. A furniture system according to claim 10 including a lower arm portion connected to and forming a single non-detachable structure with said seat portion at one of said opposite ends of the core element, said arm module comprising an upper arm module detachably connected to an upper end of said lower arm portion.

14. A furniture system according to claim 13, wherein said upper arm module and said lower arm portion include front and rear surfaces, and a plurality of arm fasteners connected to at least one of the front and rear surfaces for detachably connecting accessories.

15. A furniture system according to claim 13, including second shaping module holding means in said lower arm portion near an intersection between the lower arm portion and the seat portion, the system including an arm shaping module having an inner lower edge, the arm shaping module covering the upper arm module and lower arm portion and the inner lower edge of the arm shaping module being detachably connected to the second shaping module holding means.

16. A furniture system according to claim 15 wherein each of the first and second holding means comprise means defining a notch and a fitting connected to the lower edge of each of the back and arm shaping modules for detachably engaging into the respective notch of the first and second shaping module holding means.

17. A furniture system according to claim 16 wherein each of the first and second shaping module holding means comprises a C-shaped member extending along one of the intersections and defining a channel, the system including a baton shaped to engage in at least one of the channels for use in holding a slipcover to the furniture system.

18. A furniture system according to claim 13 including an arm shaping module detachably connected over the upper arm module and lower arm portion, the arm shaping module having an inner lower edge detachably connected to the intersection between the lower arm portion and the seat portion.

19. A furniture system according to claim 13 wherein the upper arm module has a selected final outward shape for an arm rest level of the furniture system.

20. A furniture system according to claim 19 including a side module detachably connected to a side of the back portion, above the arm module.

21. A shape changeable furniture system comprising:

an L-shaped core element having a horizontally extending seat portion and a vertically extending back portion connected to and forming a single non-detachable structure with said seat portion, said seat and back portions being non-detachably connected to each other at an elongated intersection, said core element having opposite ends;

a back shaping module detachably connected to said core element and extending over said back portion, said back shaping module having a front lower edge extending to said intersection;

first shaping module holding means at said intersection for holding the front lower edge of said back shaping module to the intersection of said core element;

at least one arm module detachable connected to one of said opposite ends of said core element; and the shaping module holding means comprises a C-shaped channel member defining an elongated channel along the intersection, the system including a baton engageable into the channel for holding a slipcover to the furniture system.

22. A shape changeable furniture system comprising:

an L-shaped core element having a horizontally extending seat portion and a vertically extending back portion connected to and forming a non-detachable structure with said seat portion, said seat and back portions being non-detachably connected to each other at an elongated intersection, said core element having opposite ends;

at least one arm module detachably connected to one of said opposite ends of said core element;

a plurality of feet connected to a lower surface of the core element adjacent both of the opposite ends of the core element;

the arm module comprising a full arm module extending from a lower end of the seat portion to an upper arm rest level, anchor means detachably connected between the full arm module and the opposite end of the core element for detachably fixing the arm module to the core element, and foot engaging means at a lower end of the full arm module for interacting with the feet at the one opposite end of the core element for supporting the full arm module on the feet; and the anchor means comprising a plurality of anchors detachably connected between the arm module and the core element, and a rib with groove engaged by the rib, connected between the arm module and core element for fixing a relative position between the arm module and core element.

23. A furniture system according to claim 22 including an arm shaping module detachably connected over the full arm module, the arm shaping module having a front lower edge and means at an intersection between the arm module and the seat portion of the core element for detachably holding the front lower edge of the arm shaping module.

24. A furniture system according to claim 22, including a back shaping module detachably connected to the core element over the back portion, and means in the intersection between the seat and back portions for holding a front lower edge of the back shaping module.

25. A furniture system according to claim 22 including an arm top table assembly comprising an arm top table member and a plurality of brackets extending downwardly from the arm top table member and embracing the upper arm module.

26. A furniture system according to claim 22 including an arm member formed at least partly of the arm module, the is arm member having a front surface, at least one arm front fastener at the front surface and at least one accessory detachably connected to the fastener.

27. A furniture system according to claim 26 wherein the accessory comprises a side table engaged to the arm member and a support connected between the side table and the fastener.

28. A furniture system according to claim 26 wherein the accessory comprises a cup holder.

29. A furniture system according to claim 26 wherein the accessory comprises a cane holder.

30. A furniture system according to claim 26 including an arm member at both ends of the core element, both arm members having a front surface and a front arm fastener at the front surfaces, the accessory comprising a bolster connected across the seat portion and detachably connected to each of the fasteners of each of the arm members.

31. A furniture system according to claim 26 wherein the accessory comprises a tablet and means pivotally connecting the tablet to the fastener.

32. A furniture system according to claim 31 wherein the means for pivotally connecting the tablet to the fastener comprise a slide detachably connected at a selected and variable vertical position to the front surface of the arm member, a guide fixed to the slide and a post connected to the tablet and mounted for engagement in the guide in a plurality of rotationally fixed positions.

33. A furniture system according to claim 32 including a channel member detachably connected to the fastener and extending along the front surface of the arm member, the slide being slidably mounted to the channel member.

34. A furniture system according to claim 33 wherein the channel member includes a toothed rail, at least one spring loaded detente movably connected to the slide and movable between a position engaged with teeth of the toothed rail for fixing a relative vertical position between the slide and the channel member, and a second position spaced away from the toothed rail for free vertical movement of the slide.

35. A furniture system according to claim 33 wherein the guide includes an opening for receiving the post, the opening having at least one recess, the post having at least one projection for engagement in the recess for fixing a rotational position between the tablet and the arm member.

36. A furniture system according to claim 33 including a table extension pivotally mounted to the tablet for pivoting between a closed position lying on an upper surface of the tablet and an open position extending adjacent to tablet.

37. A furniture system according to claim 22 including an arm member having a rear surface and formed at least partly by said arm module, a plurality of fasteners connected to said rear surface, a canopy for extending over at least a portion of the core element and a support connected between the canopy and the fasteners.

38. A furniture system according to claim 37 including an extension having a variable length connected between the canopy and the support for adjusting an angle of the canopy.

39. A furniture system according to claim 37 wherein the fasteners comprise openings into the arm member, the support having a plurality of posts detachably engaged into each of the fastener openings.

40. A furniture system according to claim 22 including a form-fitted slipcover over the core element with attached arm modules, shaped to closely fit the core element and attached arm modules.

41. A furniture system according to claim 40 wherein the slipcover includes pockets at each of the intersections for receiving a baton to anchor the slipcover to the core element with arm modules.

42. A shape changeable furniture system comprising:

an L-shaped core element having a horizontally extending seat portion and a vertically extending back portion connected to and forming a non-detachable structure with said seat portion, said seat and back portions being non-detachably connected to each other at an elongated intersection, said core element having opposite ends;

at least one arm module detachably connected to one of said opposite ends of said core element;

a plurality of feet connected to a lower surface of the core element adjacent both of the opposite ends of the core element;

a back shaping module detachably connected to the core element over the back portion, and means in the intersection between the seat and back portions for holding a front lower edge of the back shaping module; and a groove in an upper surface of the back portion and a rib on an inner surface of the back shaping module and engageable into the groove for fixing a relative position between the back shaping cover module and the back portion.

43. A furniture system according to claim 42 including a side module detachably connected to a side of the back portion, above the arm module.

44. A furniture system according to claim 42 including a form fitted slipcover and a skirt detachably connected around a lower end of the core element with attached arm module, and over the slipcover, for obstructing a view of the feet.

45. A furniture system according to claim 42 wherein the feet are connected to a lower surface of the lower arm portion for supporting the core element by support of the lower arm portion.

46. A furniture system according to claim 45 wherein each of the feet includes at least a side extension with an upper open recess for receiving a support.

47. A furniture system according to claim 45 wherein each of the feet includes a recess for detachably receiving a support.

48. A furniture system according to claim 47 including a side table assembly, the lower arm portion including a frame element, the table assembly including at least one bracket for engaging the frame element and a support connected between the assembly and the recess in the foot.

49. A shape changeable furniture system comprising:

an L-shaped core element having a horizontally extending seat portion and a vertically extending back portion connected to and forming a non-detachable structure with said seat portion, said seat and back portions being non-detachably connected to each other at an elongated intersection, said core element having opposite ends;

at least one arm module detachably connected to one of said opposite ends of said core element;

a plurality of feet connected to a lower surface of the core element adjacent both of the opposite ends of the core element;

a back shaping module detachably connected to the core element over the back portion, and means in the intersection between the seat and back portions for holding a front lower edge of the back shaping module; and the means in the intersection including an elongated member defining a notch for receiving a fitting at the front lower edge of the back shaping module, and a nose adjacent the notch around which the front lower edge of the back shaping module is engaged.

50. A furniture system according to claim 49 wherein the elongated member comprises a channel member defining a channel along the intersection adjacent the notch.

51. A furniture system according to claim 50 wherein the channel member is C-shaped in cross-section.

* * * * *

UNITED STATES PATENT AND TRADEMARK OFFICE

CERTIFICATE OF CORRECTION

PATENT NO. : 5,775,778

DATED : July 7, 1998

INVENTOR(S) : Paula Riley, et al

It is certified that error appears in the above-identified patent and that said Letters Patent is hereby corrected as shown below:

Item [73] Assignee: change "Prescient Partners, LP" to --New$^2$rinkle, L.L.C.--

Signed and Sealed this

Third Day of November, 1998

*Attest:*

*Attesting Officer*

BRUCE LEHMAN

*Commissioner of Patents and Trademarks*